US006691691B1

(12) United States Patent
Beynon et al.

(10) Patent No.: US 6,691,691 B1
(45) Date of Patent: Feb. 17, 2004

(54) TABLE TENNIS BALL DISTRIBUTION AND STORAGE APPARATUS AND METHOD

(75) Inventors: Brian Beynon, 2323 White Ave., Santa Barbara, CA (US) 93109; John Stump, Santa Barbara, CA (US); Tim Armstrong, Clarks Summit, PA (US)

(73) Assignee: Brian Beynon, Santa Barbara, CA (US)

( * ) Notice: Subject to any disclaimer, the term of this patent is extended or adjusted under 35 U.S.C. 154(b) by 0 days.

(21) Appl. No.: 10/346,850

(22) Filed: Jan. 18, 2003

(51) Int. Cl.[7] ..... F41B 15/00
(52) U.S. Cl. ..... 124/16; 124/41.1; 124/49
(58) Field of Search ..... 124/16, 26, 31, 124/36, 41.1, 49, 82

(56) References Cited

U.S. PATENT DOCUMENTS 4,091,791 A * 5/1978 Castelli et al. ..... 124/73
4,886,269 A * 12/1989 Marocco ..... 473/431

* cited by examiner

*Primary Examiner*—Jacob K. Ackun
(74) *Attorney, Agent, or Firm*—Lyon & Harr, L.L.P.; Craig S. Fischer

(57) ABSTRACT

The table tennis ball distribution and storage apparatus and method described herein stores a plurality of table tennis balls and automatically projects a single ball on command. The apparatus includes an integrated timing system that simultaneously loads a single ball from a storage unit into a firing cavity, cuts power to a motor to keep the ball within the firing cavity, and arms a flipper system. The integrated timing system includes an integrated ball support/feeder system, a flipper system, and an actuator system. The integrated ball support/feeder system both supports the stored balls and loads a single ball into the firing cavity. The flipper system is used on the apparatus to propel the ball in an exact and proper trajectory. An actuator system controls the timing of the flipper system. The table tennis ball distribution and storage method uses the apparatus to store and distribute table tennis balls.

26 Claims, 23 Drawing Sheets

TABLE TENNIS BALL DISTRIBUTION AND STORAGE APPARATUS AND METHOD

TECHNICAL FIELD

The present invention relates in general to the automatic dispensing and distribution of balls and more particularly to table tennis ball distribution and storage apparatus for storing a plurality of balls and automatically projecting a single ball onto a table tennis table on command to provide an uninterrupted flow of play.

BACKGROUND OF THE INVENTION

Table tennis (also known as "ping-pong") is a popular game in which persons on either side of a table exchange turns hitting a small ball back and forth to each other. Early in its development, table tennis evolved from an amateur game into a sport. Proficient table tennis players are capable of fast-paced exchanges and can sometimes keep the ball in play for long periods of time.

A large number of table tennis players, however, are amateurs and novices. When playing table tennis, these amateurs spend a disproportionate amount of time retrieving errant balls. This is not only time-consuming but also laborious. Another problem is that players may use a large number of balls during play because there is no convenient supply of balls nearby. Although balls may be placed in one's pockets, this method both requires the user to access the balls and only allows a few balls to be stored. If the balls are stored away from the table, this requires the player to walk to a location away from the table to obtain additional balls. Thus, what is needed is a table tennis ball distribution and storage apparatus that provides an automatic and convenient supply of balls and is capable of automatically distributing the balls to a player as desired.

SUMMARY OF THE INVENTION

The table tennis ball distribution and storage apparatus and method described herein is designed to store a plurality of table tennis balls and automatically distributed a single ball from that store to a player. The apparatus and method alleviate the need for a player to constantly retrieve errant balls and the associated aggravation. In addition, the apparatus and method provides table tennis amateurs and novices with better enjoyment of the game since the flow of the game is not interrupted by the chasing balls or looking for additional balls.

In general, table tennis ball distribution and storage apparatus includes a number of systems and components that provide a simple, effective and efficient mechanism to store and automatically distribute a table tennis ball to a player on command. Specifically, the apparatus includes an integrated timing system. This integrated timing system simultaneously loads a single ball from a storage unit into a firing cavity, cuts power to a motor to keep the ball within the firing cavity, and arms a flipper system. On command the flipper system is released, the ball is struck and propelled along a preset trajectory to the player. This integrated timing system greatly decreases the complexity of the apparatus as well as increasing its reliability.

The components of the integrated timing system include an integrated ball support/feeder system, a flipper system, and an actuator system. The integrated ball support/feeder system both supports the balls stored in the storage unit and loads a single ball into the firing cavity. The flipper system is used on the apparatus to propel the ball in an exact and proper trajectory. An actuator system controls the timing of the flipper system. The apparatus is driven by an offset reduction gear system. The offset reduction gear system uses an offset worm drive instead of a direct drive to provide enhanced performance, reliability and compactness. Using a worm drive instead of a direct drive means that a smaller motor can be used and only two gears are needed.

The table tennis ball distribution and storage method uses the apparatus to store and distribute table tennis balls. In general, the method includes storing a plurality of table tennis balls using a tiered ball storage unit and automatically distributing a single ball to a player. In particular, a plurality of balls is loaded into the tiered ball storage unit and the balls are held up by a slider. An actuator switch is depressed causing the motor to stop. When an actuator button is depressed, the motor begins spinning and causes the release of the flipper system. This strikes the ball in the firing cavity and propels the ball upward. Meanwhile, the rotation of the motor causes the slider to align with a feeder cavity and obtain a single ball from the storage unit. The single ball is displaced by the slider from the feeder cavity to the firing cavity. At this point, the actuator switch is depressed by the flipper system and the motor stops, thus arming the flipper system and ball in the firing cavity. On command, the actuator button is depressed and the cycle begins again.

BRIEF DESCRIPTION OF THE DRAWINGS

The present invention can be further understood by reference to the following description and attached drawings that illustrate aspects of the invention. Other features and advantages will be apparent from the following detailed description of the invention, taken in conjunction with the accompanying drawings, which illustrate, by way of example, the principles of the present invention.

Referring now to the drawings in which like reference numbers represent corresponding parts throughout.

DETAILED DESCRIPTION OF THE INVENTION

In the following description of the invention, reference is made to the accompanying drawings, which form a part thereof, and in which is shown by way of illustration a specific example whereby the invention may be practiced. It is to be understood that other embodiments may be utilized and structural changes may be made without departing from the scope of the present invention.

I. General Overview

Figure 1:
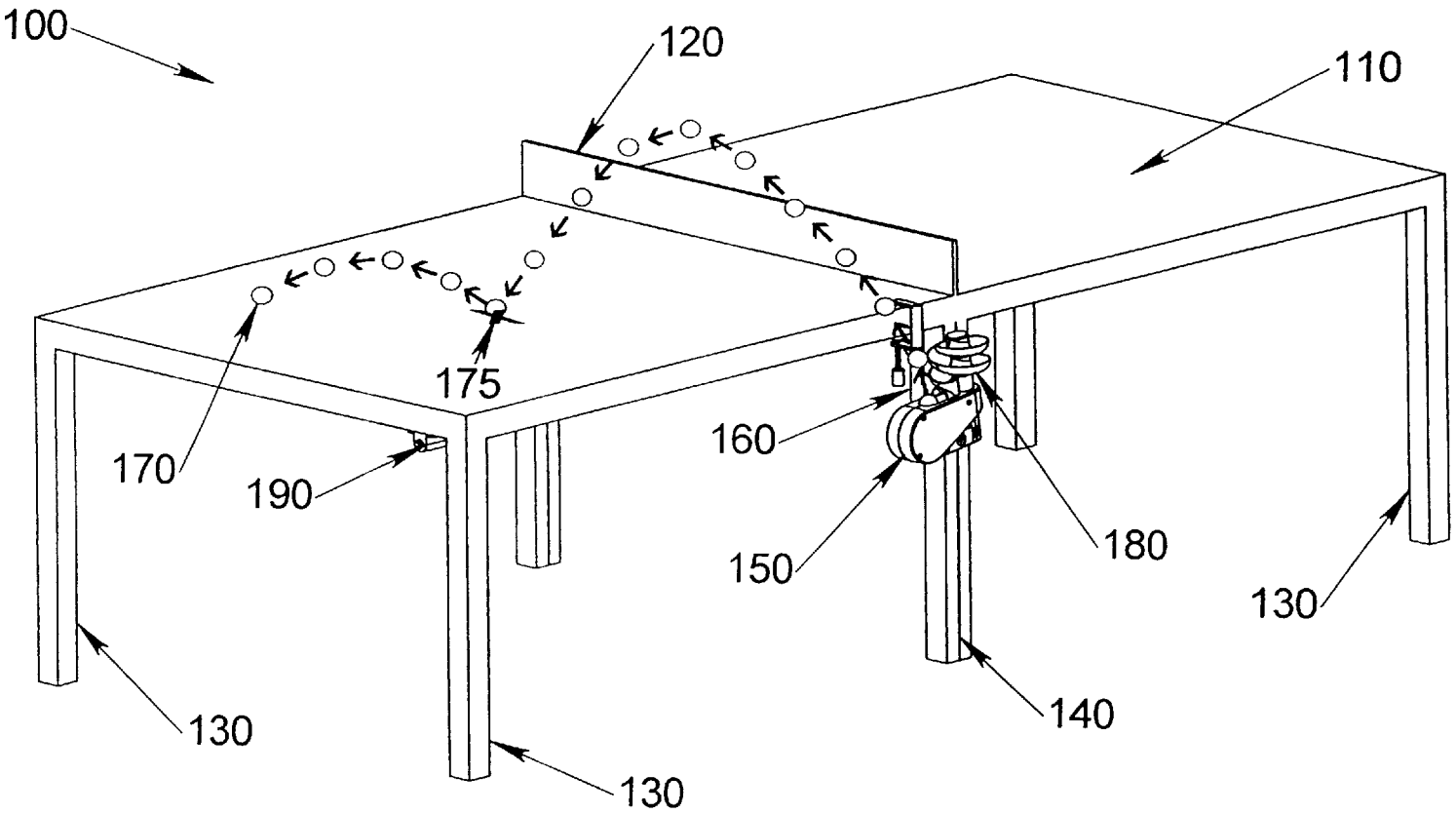
FIG. 1 is a perspective view illustrating a general overview of an exemplary embodiment of the table tennis ball distribution and storage apparatus and method in a table tennis environment.

The table tennis ball distribution and storage apparatus and method described herein is designed operate in a table tennis environment. FIG. 1 illustrates a perspective view of an exemplary embodiment of the table tennis ball distribution and storage apparatus and method in a table tennis environment 100. In general, the table tennis ball distribution and storage apparatus and method stores table tennis balls and automatically distributes a single ball at a time to a player. Specifically, referring to FIG. 1, the table tennis environment includes a table tennis table 110 having a net 120. The table 110 typically has four outer legs 130 and a pair of double legs 140 in the center of the table 110. These double legs 140 allow the table 110 to be folded in half when not in use.

Attached to a side of the table 110 is table tennis ball distribution and storage apparatus 150. Although in this exemplary implementation the apparatus 150 is attached only to one side of the table 110, it should be noted that the apparatus 150 may also be attached at other places on the table 110. For example, the apparatus 150 may be attached to the other side of the table 110. In addition, more than one apparatus 150 may be attached to the table 110, such as, for example, attaching one apparatus 150 on each side the table 110 or having two apparatuses 150 on one side of the table 110. In any of these cases the apparatus 150 is attached to the table 110 using an attachment device 160 (such as a swivel clamp).

The apparatus 150 is designed to store and automatically distribute a table tennis ball 170 to a player (not shown) standing at one end of the table 110. As shown in FIG. 1 by the arrows, the ball 170 is ejected with a force from the apparatus 150. The ball 170 is ejected with enough force that the ball 170 follows a trajectory and contacts the table 110 at a contact point 175. After contact with the table 110, the ball 170 bounces up and is ready to be hit by the player.

The ball 170 is one of many balls that may be stored by the apparatus 150. The balls are stored in a tiered ball storage unit 180. As explained in detail below, the tiered ball storage unit 180 both stores a plurality of balls and feed a single ball 170 at a time into a position where the ball 170 can be automatically distributed to the player. As also explained below, the tiered ball storage unit 180 is modular and the number of balls that may be stored by the apparatus 150 can be easily varied.

The apparatus 150 also includes an actuator button 190 that allows the player to cause the apparatus 150 to distribute the ball 170. For example, if the player has hit a ball out of play and would like another ball to resume play, the player merely depresses the actuator button 190 and the apparatus will distribute the ball 170 to the player as previously explained. It should be noted that although the actuator button 190 is shown mounted on the table 110, the button 190 may be mounted in other locations or held by the player. In addition, in some situations the actuator button 190 may not be needed because the apparatus 150 can be placed in an cyclic mode whereby a ball is distributed at a certain time interval.

II. Table Tennis Ball Distribution and Storage Apparatus

The table tennis ball distribution and storage apparatus 150 described herein stores a plurality of balls and automatically distributes a ball to a player on command. The apparatus 150 includes an integrated timing system whereby a ball is loaded, power is cut to a motor, and a flipper system is armed. Once armed, the flipper system is ready to strike the ball and propel it to the player. As described below, the apparatus 150 also includes a number of other components that provide a simple, effective and efficient mechanism to store and automatically distribute a table tennis ball to a player.

Figure 2:
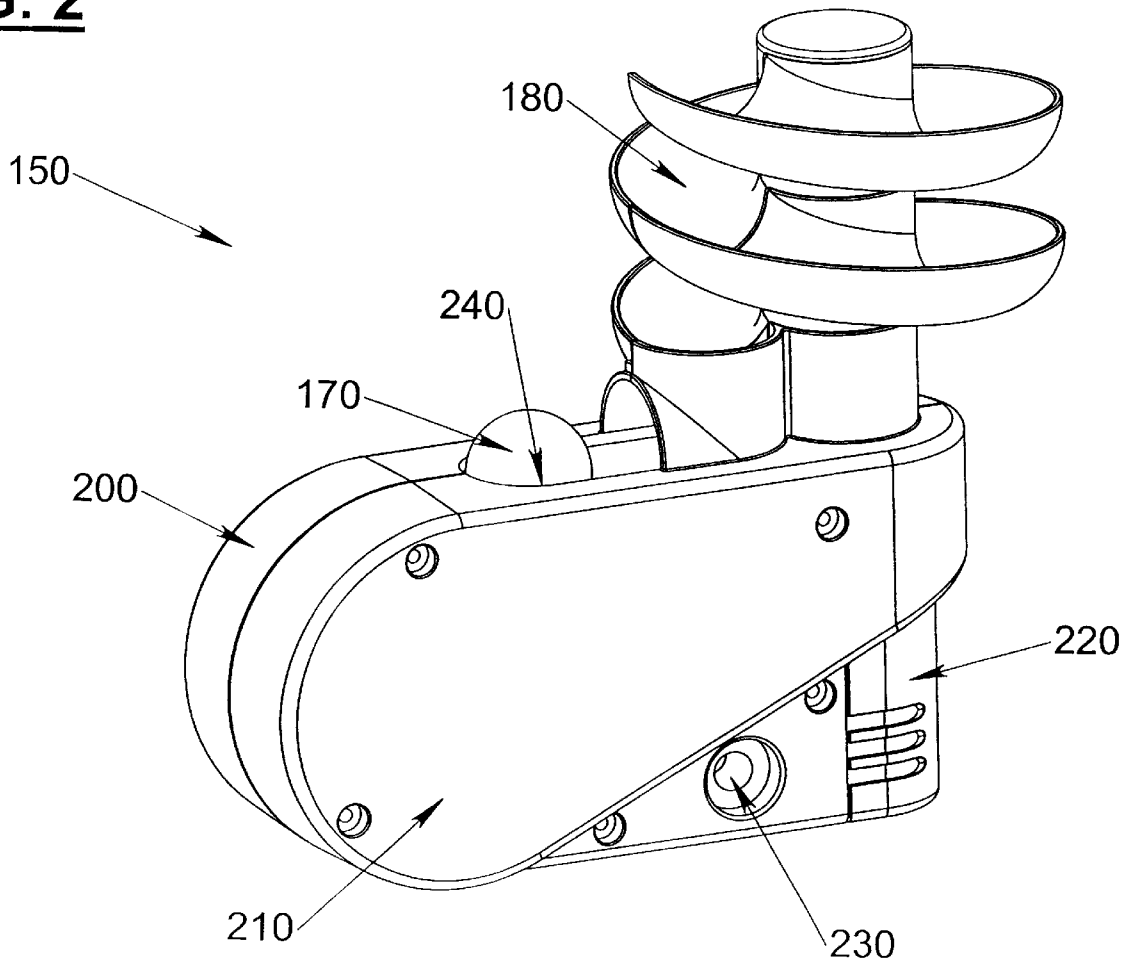
FIG. 2 illustrates a side view of the table tennis ball distribution and storage apparatus described herein and shown in FIG. 1.

FIG. 2 illustrates a side view of the table tennis ball distribution and storage apparatus 150 shown in FIG. 1. In particular, the right side of the apparatus 150 is shown. The apparatus 150 includes a left outer body 200 and a right outer body 210 that are shown assembled together to form an integral outer body of the apparatus 150. A battery cover 220 forms a part of the integral outer body and is used to cover a battery compartment. A mounting hole 230 formed in the left outer body 200 and the right outer body 210 is used to provide an attachment point for the attachment device 160. Disposed on an upper side of the integral outer body is the tiered ball storage unit 180. The tiered ball storage unit 180 provides a storage area for a plurality of balls. In addition, the tiered ball storage unit 180 feeds a ball 170 into a firing cavity 240 of the apparatus 150. Once in the firing cavity 240, the ball 170 is capable of being propelled from the apparatus 150.

Figure 3:
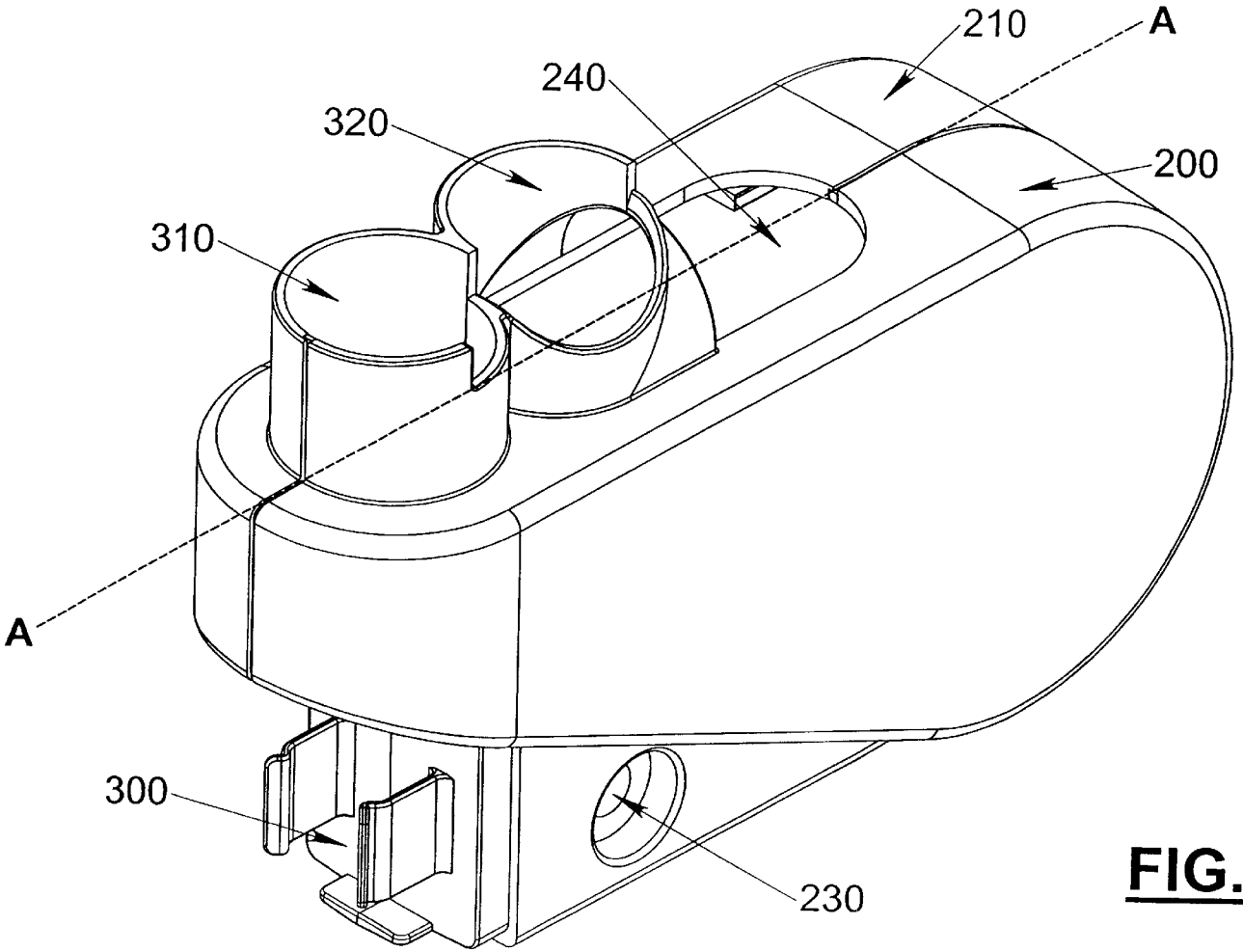
FIG. 3 illustrates a perspective view of the integral outer body of the table tennis ball distribution and storage apparatus shown in FIG. 2.

FIG. 3 illustrates a perspective view of the integral outer body of the table tennis ball distribution and storage apparatus 150 shown in FIG. 2. The apparatus is shown without the tiered ball storage unit 180 and without the battery cover 220. As shown in FIG. 3, the integral outer body includes the left outer body 200 and the right outer body 210. These two outer bodies 200, 210 are fastened together using fastening agents such as screws or glue. The mounting hole 230 provides an attachment point for the attachment device 160. A battery compartment 300 is located at one end of the apparatus 150 and is used to hold a battery (not shown). The battery is used to provide power for a motor. The battery may be a standard nine-volt battery (not shown) that can be snapped into the battery compartment 300 and covered by the battery cover 220. It should be noted that other means of providing power can be used, such as, for example, an alternating current (A/C) cord having a transformer to provide necessary power to the motor.

The integral outer body also includes an attachment cavity 310 on the upper side of the apparatus 150. The attachment cavity 310 provides an attachment point for the tiered ball storage unit 180. In particular, the tiered ball storage unit 180 is inserted into the attachment cavity 310 to secure the tiered ball storage unit 180 on the integral outer body. A feeder cavity 320 is formed in the integral outer body to receive a ball from the tiered ball storage unit 180. As explained below, a slider is used to provide a means whereby the ball can drop into the feeder cavity 320 and onto the slider for displacement to the firing cavity 240.

III. Apparatus and Component Details

Figure 4:
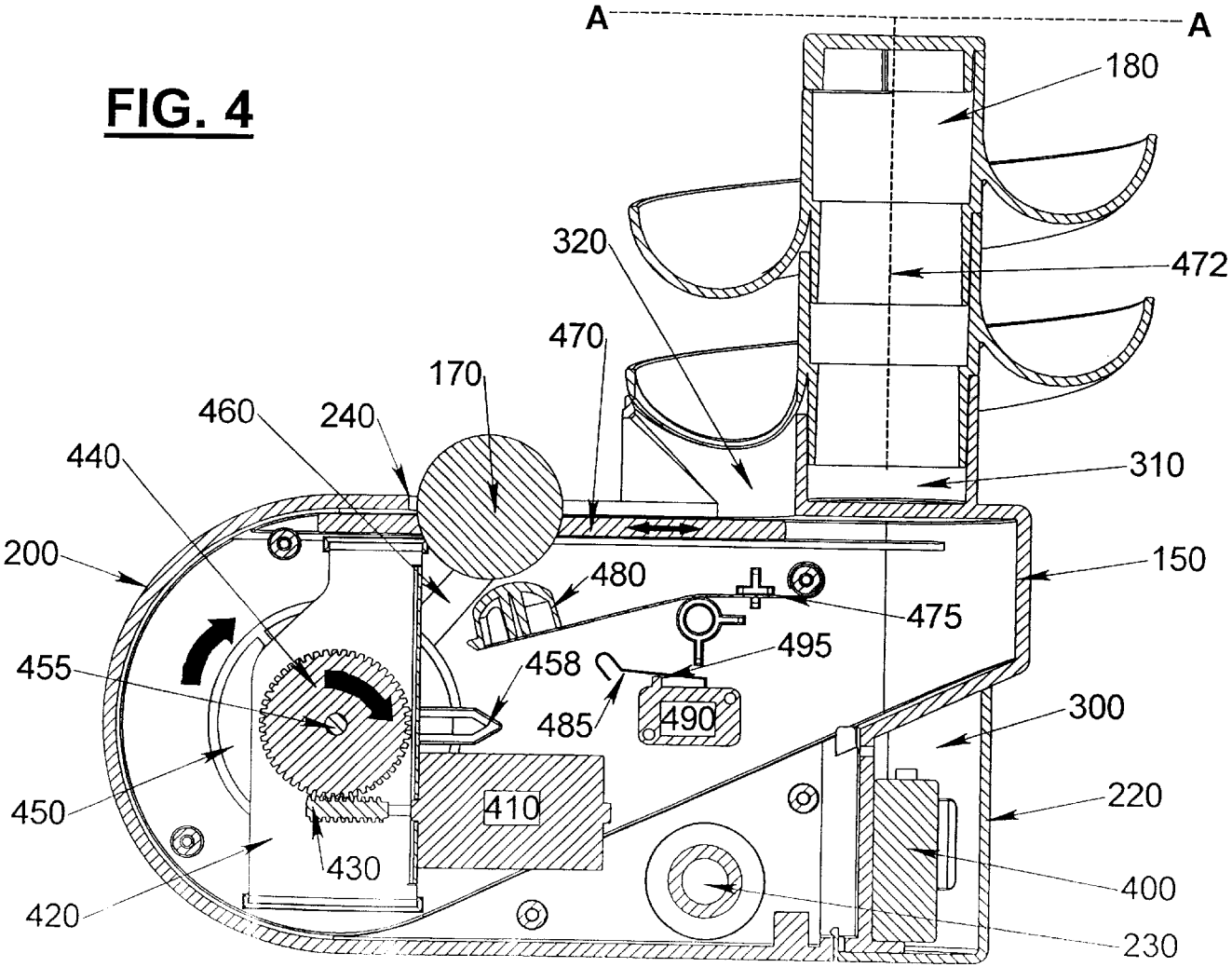
FIG. 4 illustrates a cutaway side view of the table tennis ball distribution and storage apparatus along the dashed line A—A shown in FIG. 3.

The details of the apparatus 150 and associated components will now be discussed. FIG. 4 illustrates a cutaway side view of the table tennis ball distribution and storage apparatus 150 along the dashed line A—A shown in FIG. 3. FIG. 4 illustrates looking at the interior of the apparatus 150 from the right side of the apparatus 150. Power is supplied by a battery 400 that is held inside the battery compartment 300 and covered by the battery cover 220. The battery 400 provides power for a motor 410. In a preferred embodiment, the motor 410 is a nine-volt direct current (DC) motor. The motor 410 is held in place by a motor bracket 420. The motor bracket 420 is friction fitted into cavities of the left outer body 200 and the right outer body 210. Alternatively, the motor bracket 420 can be fastened to either the left outer body 200, the right outer body 210, or both. The motor 410 is attached to the motor bracket 420 by use of a fastening means or friction fitted into place.

The motor 410 is used to drive an offset reduction gear system. The offset reduction gear system uses an offset worm drive instead of a direct drive to provide enhanced performance, reliability and compactness of the apparatus 150. Specifically, the advantage of the offset reduction gear system is that a smaller motor can be used in the apparatus 150. A smaller motor means that the apparatus is lighter, more compact and requires less power. In turn, the reduction in power required means that less heat is generated thereby greatly reducing or eliminating the need for additional cooling devices or means. In addition, the gearing ratio can be changed as needed depending on a particular application of the apparatus 150.

The offset reduction gear system also reduces the number of gears needed as opposed to a direct drive system. In particular, the apparatus 150 uses only two gears, namely, a worm gear 430 and a reduction gear 440. The worm gear 430 is attached to a shaft of the motor 410. The worm gear 430 in turn is used to drive a reduction gear 440. The reduction gear turns a left cam wheel 450. Both the reduction gear 440 and the left cam wheel 450 are disposed on a reduction shaft 455 that is mounted on the motor bracket 420. The left cam wheel 450 includes a cam 458.

The left cam wheel 450 is used to drive an integrated ball support/feeder system. This integrated ball support/feeder system is used to both support the balls stored in the tiered ball storage unit 180 and displace a single ball from the storage unit 180 to the firing cavity 240. Specifically, the left cam wheel 450 has attached thereon a left arm 460 that is attached to a slider 470. The slider 470 is capable of moving back and forth in a linear motion along a single dimension of the apparatus 150. In particular, as shown by the arrow in FIG. 4, the slider 470 moves in a direction that is perpendicular to an imaginary main axis 472 (shown by the dashed line) of the tiered ball storage unit 180. The slider 470 provides a means whereby the ball 170 in the tiered ball storage unit 180 is held up in the storage unit 180 until a portion of the slider 470 aligns with the feeder cavity. Once this alignment occurs, the single ball 170 drops on to the slider 470 and is transported to the firing cavity 240.

A flipper system is used on the apparatus 150 to propel the ball 170. The flipper system includes a flipper spring 475 and a flipper foot 480 attached to one end of the flipper spring 475. The flipper spring is mounted on the left outer body 200 such that the flipper foot 480 is centered under the ball 170. When armed and released, this allows the flipper system to strike the ball 170 sufficient force to propel the ball 170 from the firing cavity 240.

The apparatus 150 also includes an actuator system that controls the timing of the flipper system. In particular, the actuator system includes an actuator arm 485 is disposed on an actuator unit 490. The actuator unit 490 includes an actuator switch 495. The actuator arm 485 is movably attached to the actuator unit 490 such that the actuator arm 485 is biased in an upright position absent any other force on the arm 485. When the actuator arm 485 is in the upright position, the actuator switch 495. On the other hand, when the actuator arm 485 is displaced downward then the actuator switch 495 is closed.

The integrated ball support/feeder system, flipper system, and actuator system are part of an integrated firing system that performs three functions. These three functions include: (1) loading the ball 170 into the firing cavity 240; (2) arming the flipper spring 475; and (3) disabling power to the motor 410. The operation of the integrated firing system is discussed in detail below.

Figure 5:
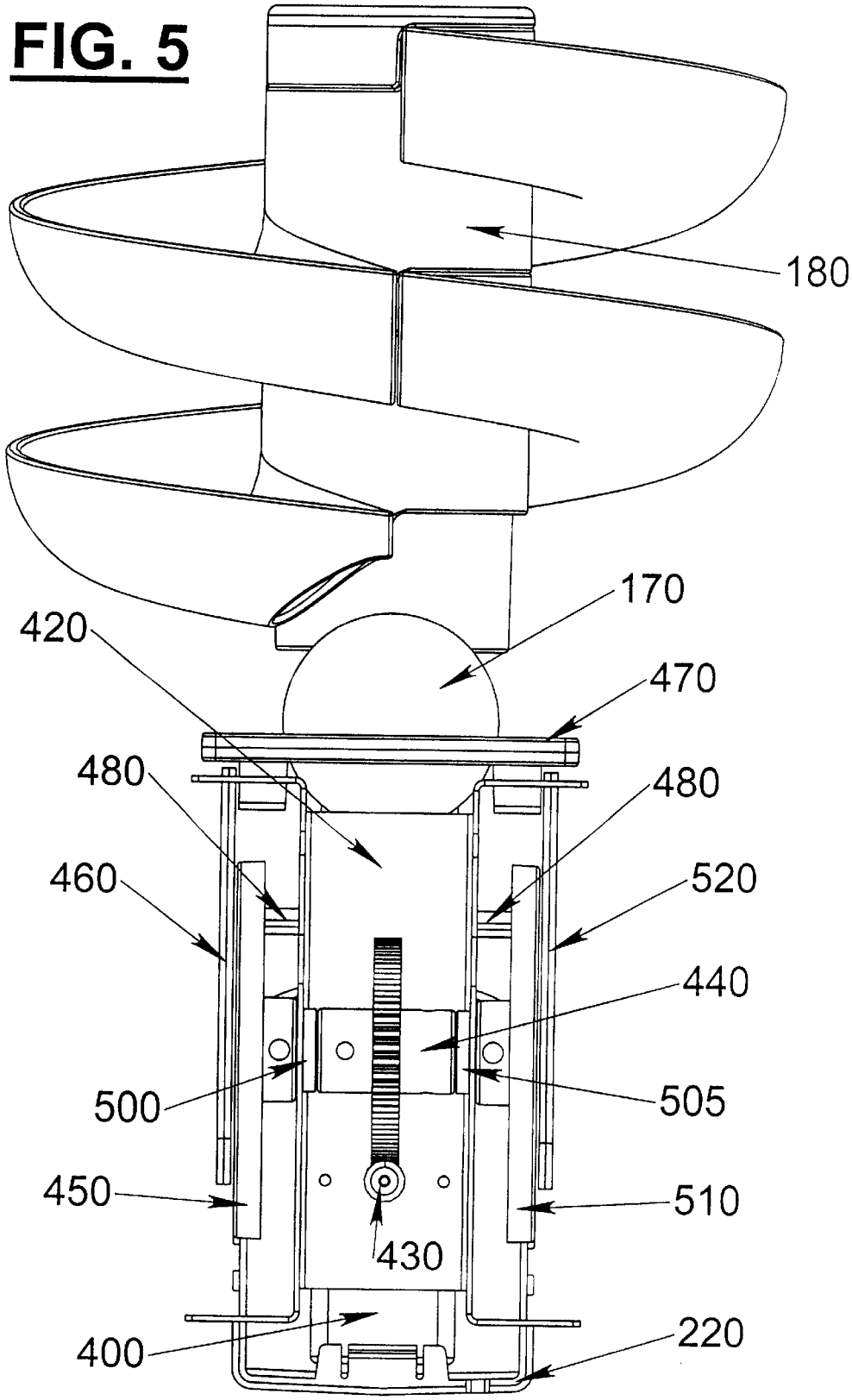
FIG. 5 illustrates an end interior view of the table tennis ball distribution and storage apparatus shown in FIG. 4 without the outer body.

FIG. 5 illustrates an end interior view of the table tennis ball distribution and storage apparatus 150 shown in FIG. 4. This view shows the interior of the apparatus without the integral outer body. In addition, this view illustrates that the right side of the apparatus 150 contains similar parts to the left side. The tiered ball storage unit 180 is mounted on the apparatus 150 and is used for ball storage. The motor 410 (not shown), which is contained in the motor bracket 420, is powered by the battery 400 and turns the worm gear 430. The worm gear 430 in turn drives the reduction gear 440 that contains a left bushing 500 and a right bushing 505 on either side of the reduction gear 440. The reduction gear 440, the left bushing 500 and the right bushing 505 are disposed on the reduction shaft 455. Also on the reduction shaft 455 are the left cam wheel 450 and a right cam wheel 510.

Attached to the left cam wheel 450 is the left arm 460 and attached to the right cam wheel 510 is a right arm 520. Both the left arm 460 and the right arm 520 are connected to the slider 470. The slider 470 is able to move back and forth in and out of the plane of FIG. 5 in order to transport the ball 170 from the feeder cavity 320 to the firing cavity 240. In addition, a portion of the flipper foot 480 may be seen in FIG. 5.

Figure 6:
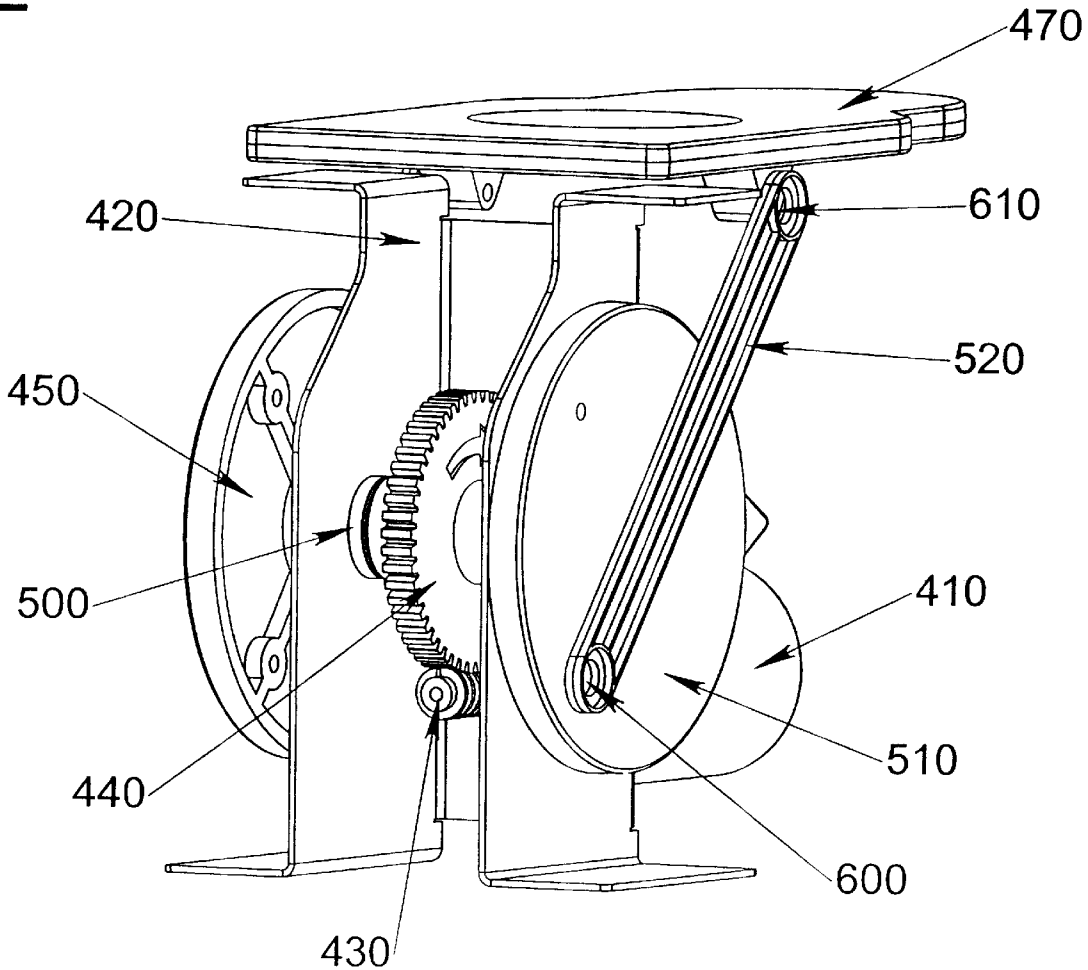
FIG. 6 illustrates a perspective view of slider and cam arrangement of the table tennis ball distribution and storage apparatus shown in FIG. 4.

FIG. 6 illustrates a perspective view of the slider and cam arrangement of the apparatus 150 shown in FIG. 4. The motor 410 is mounted to the motor bracket 420 and the motor 410 has a worm gear 430 mounted on the shaft. A reduction shaft 455 (not shown) is mounted on the motor bracket and contains the reduction gear 430, the bushing 500, 505 and the left and right cam wheels 450, 510. As can be seen in FIG. 6, the right arm 520 is rotatably attached to the right cam wheel 510 at a first right arm attachment point 600. Moreover, the right arm 520 is rotatably attached to the slider 470 at a second right arm attachment point 610. The left arm 460 is attached to the left cam wheel 450 and the slider 470 in a similar manner. In a preferred embodiment, both arms 460, 520 are fastened to the cam wheels 450, 510 and the slider 470 using screws.

Integral Outer Body Components

Figure 7:
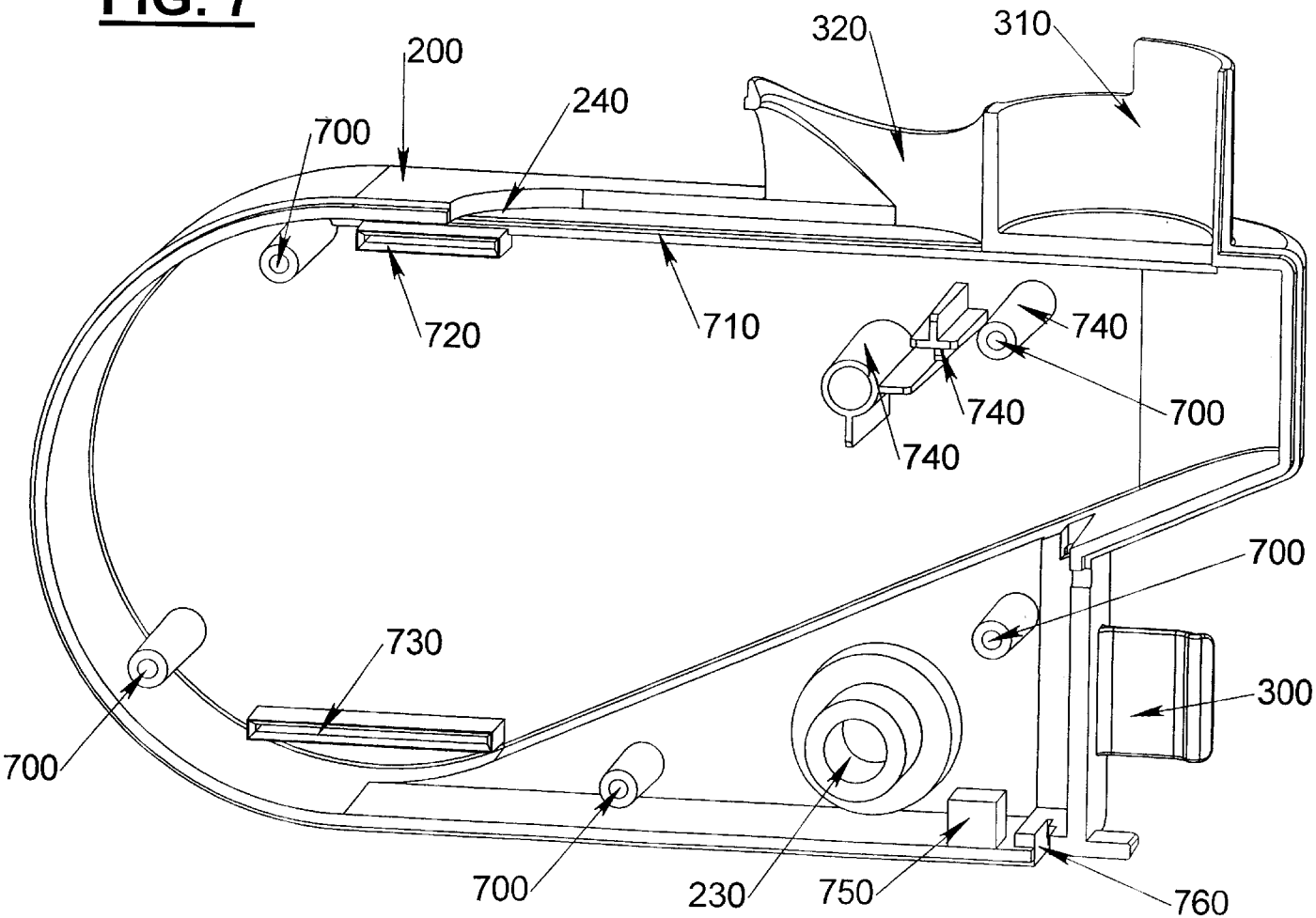
FIG. 7 illustrates a perspective view of the interior side of the left outer body of the table tennis ball distribution and storage apparatus shown in FIG. 3.

The integral outer body is composed of the left outer body 200, the right outer body 210, and a battery cover 220. FIG. 7 illustrates a perspective view of the interior side of the left outer body 200 of the table tennis ball distribution and storage apparatus shown in FIG. 3. The left outer body 200 includes the battery compartment 300 and the mounting hole 230 that provides an attachment point for the attachment device 160. In a preferred embodiment, the left outer body 200 includes screw holes 700 that allow the left outer body 200 and the right outer body 210 to be fastened together. In addition, the left outer body 200 is fashioned such that the firing cavity 240, the feeder cavity 320 and the attachment cavity 310 are formed when the left outer body 200 is joined with the right outer body 210.

The left outer body 200 also includes a slider track 710 formed in the body 200 to allow the slider 270 to move back and forth in a linear fashion. An upper motor bracket mount 720 and a lower motor bracket mount 730 are formed in the left outer body 200 to secure the motor bracket 420. A flipper spring mounting pins 740 provide a means to secure the flipper system into place and positioned the flipper system such that it aligns with the firing cavity 240. Moreover, an actuator button receptacle 750 is mounted on the left outer body 200. This receptacle 750 enables the actuator button 190 to be removable connected to the apparatus 150. A snap cavity 760 is formed in the left outer body 200 to enable the battery cover 220 to be easily attached or removed from the integral outer body.

Figure 8:
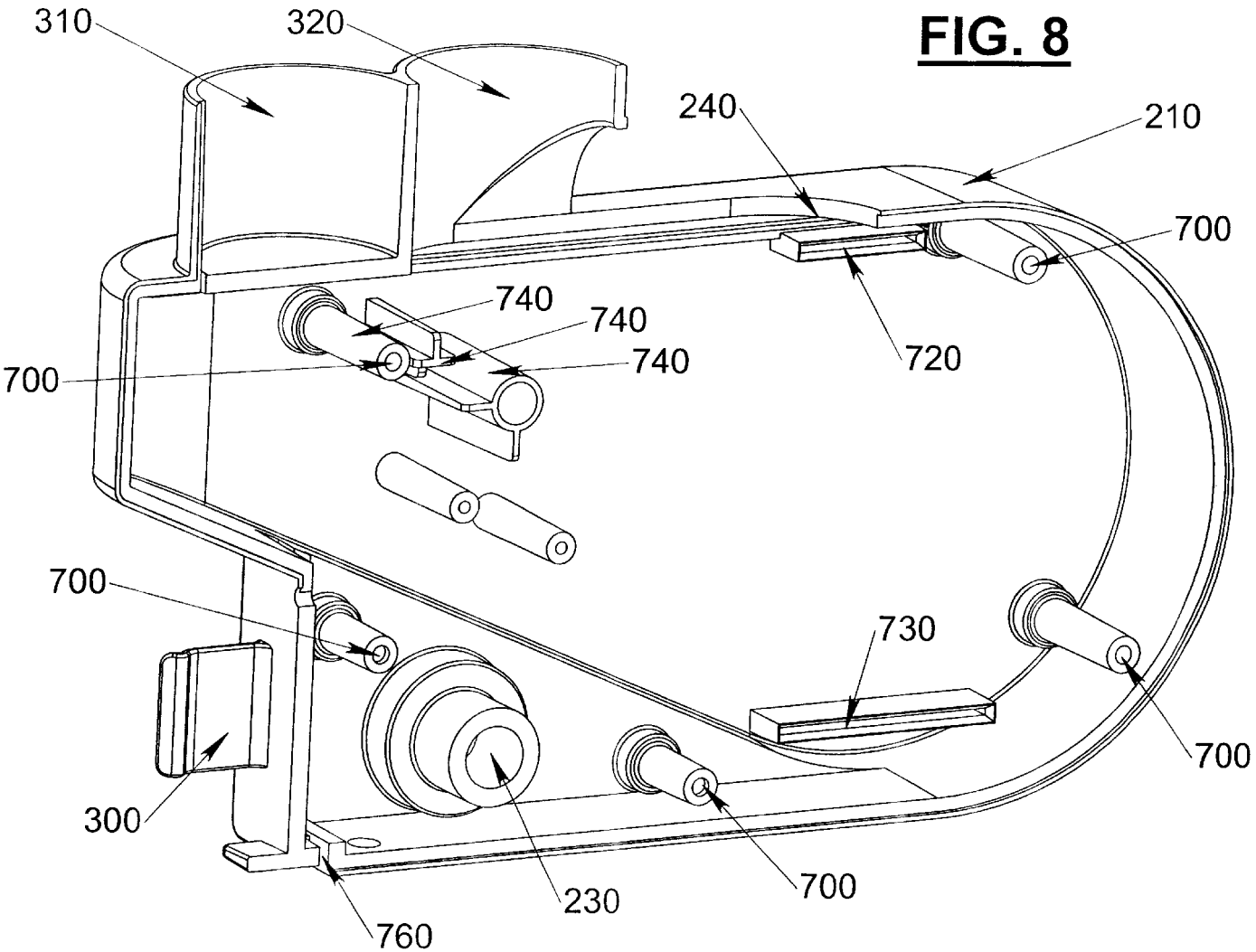
FIG. 8 illustrates a perspective view of the interior side of the right outer body of the table tennis ball distribution and storage apparatus shown in FIG. 3.

FIG. 8 illustrates a perspective view of the interior side of the right outer body 210 of the table tennis ball distribution and storage apparatus 150 shown in FIG. 3. The right outer body 210 contains components similar to the left outer body 200. In particular, right outer body 210 includes the battery compartment 300, the mounting hole 230, and screw holes 700. In addition, the right outer body 210 is fashioned such that the firing cavity 240, the feeder cavity 320 and the attachment cavity 310 are formed when the right outer body 210 is joined with the left outer body 200. The slider track 810 formed in the body 210 and the upper motor bracket mount 720 and the lower motor bracket mount 730 are used to secure the motor bracket 420. The right outer body 210 also includes the flipper spring mounting pins 740 and the snap cavity 760.

Figure 9:
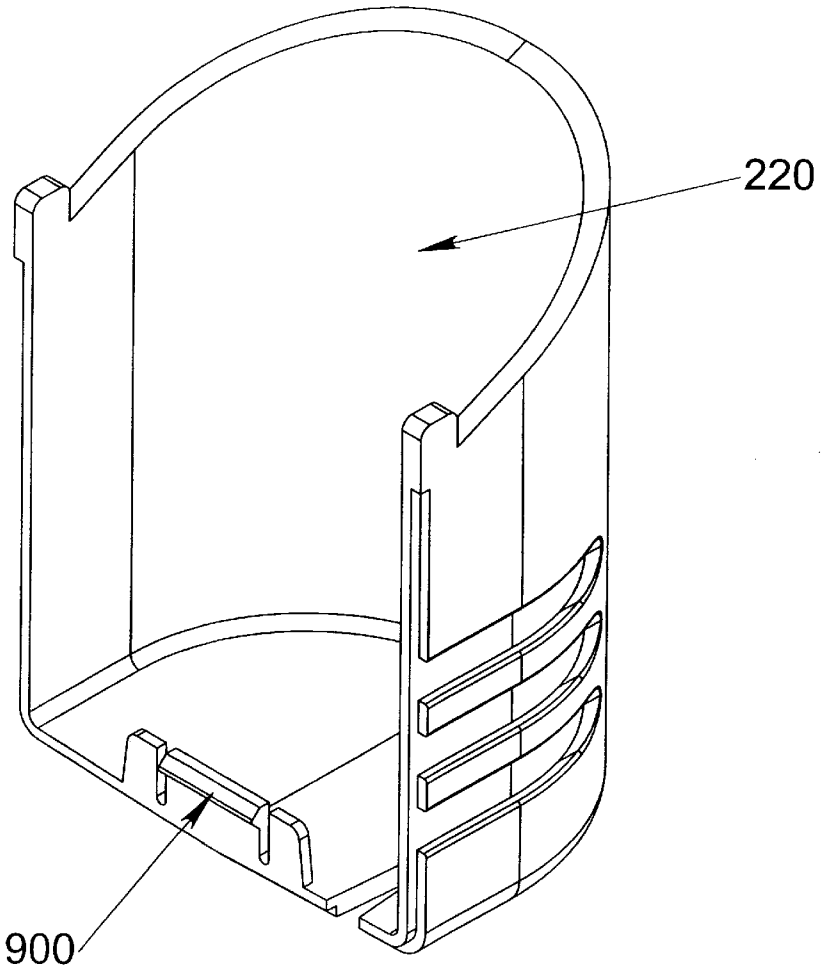
FIG. 9 illustrates a perspective view of the battery cover of the table tennis ball distribution and storage apparatus shown in FIG. 2.

FIG. 9 illustrates a perspective view of the battery cover 220 of the table tennis ball distribution and storage apparatus 150 shown in FIG. 2. The battery cover 220 is used to secure and protect the battery 400 within the battery compartment 300. In a preferred embodiment, the batter cover 220 includes a projection 900 that can be received into the snap cavity 760. This allows the battery cover 220 to be easily secured and removed from the integral outer body by snapping the battery cover 220 into place.

It should be noted that the entire integral outer body can be quickly broken down for storage or easily disassembled for servicing or maintenance. For example, the tiered ball storage unit 180 and the actuator button 190 can be disconnected from the integral outer body, and the battery cover 220, left outer body 200 and right outer body 210 can be unfastened from each other quickly and easily.

Tiered Ball Storage Unit

Figure 10:
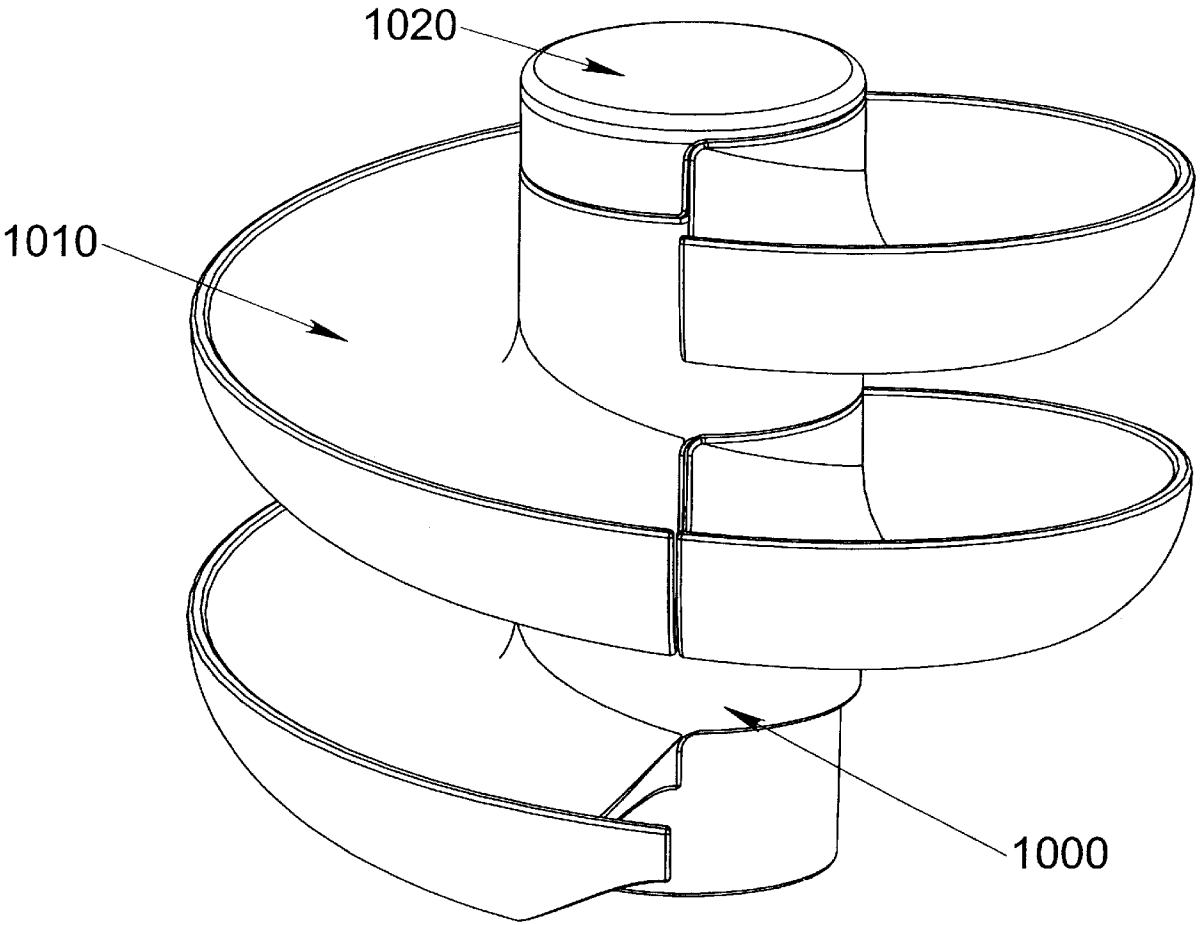
FIG. 10 illustrates a side view of the tiered ball storage unit of the table tennis ball distribution and storage apparatus shown in FIG. 2.

FIG. 10 illustrates a side view of the tiered ball storage unit 180 of the table tennis ball distribution and storage apparatus 150 shown in FIG. 2. The tiered ball storage unit 180 is modular, which allows additional storage space to be added easily and quickly. As shown in FIG. 10, the tiered ball storage unit 180 shown is a two-tiered modular unit. More specifically, the tiered ball storage unit 180 includes a lower tier 1000, an upper tier 1010, and a tier cap 1020.

Figure 11:
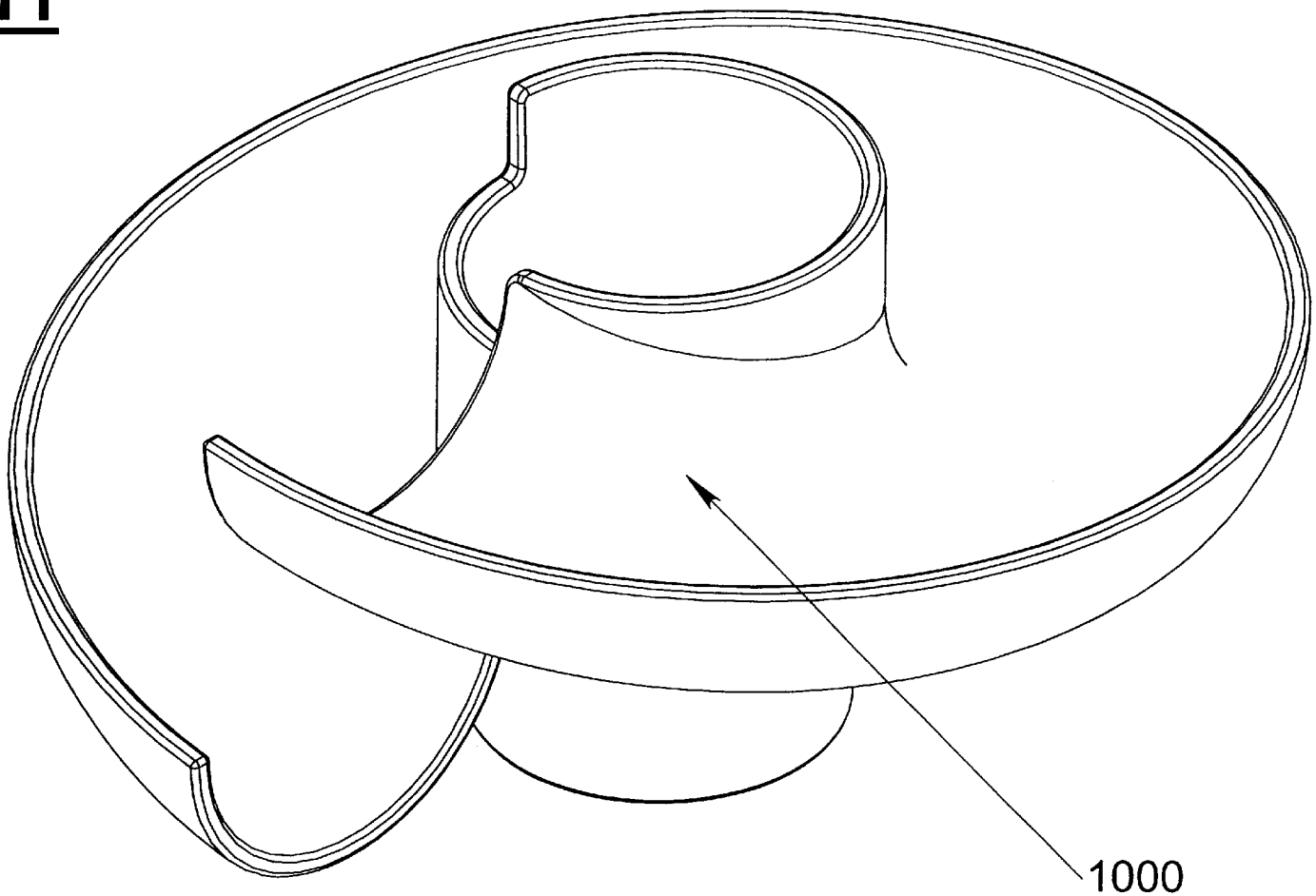
FIG. 11 illustrates a side view of the lower tier of the tiered ball storage unit shown in FIG. 10.

FIG. 11 illustrates a side view of the lower tier 1000 of the tiered ball storage unit 180 shown in FIG. 10. The lower tier 1000 is shown without the tier cap 1020. In practice, the lower tier 1000 along with the tier cap 1020 could be attached to the apparatus 150 to provide ball storage. As additional ball capacity and storage area is needed, the tier cap 1020 can be removed and additional tiers placed above the lower tier 1000.

The tiered ball storage unit 180 provides a simple and effective means to increase ball capacity and storage area quickly and easily. In addition, because of its modularity, the tiered ball storage unit 180 easily disassembles for shipping and storage. Because the tiered ball storage unit 180 is open, it is easy to load balls into the storage unit 180 and balls may be loaded from any direction. The open design of the storage unit 180 also makes it easy for players to determine how many balls are remaining in the storage unit 180. In a preferred embodiment, the tiered ball storage unit 180 accommodates balls having diameters of 38 millimeters and 40 millimeters.

Offset Reduction Gear System

The offset reduction gear system used in the apparatus 150 uses an offset worm drive instead of a direct drive. The provides enhanced performance, reliability and compactness by allowing the use of a smaller motor. In addition, the fewer gears are needed to operate the apparatus 150.

Figure 12:
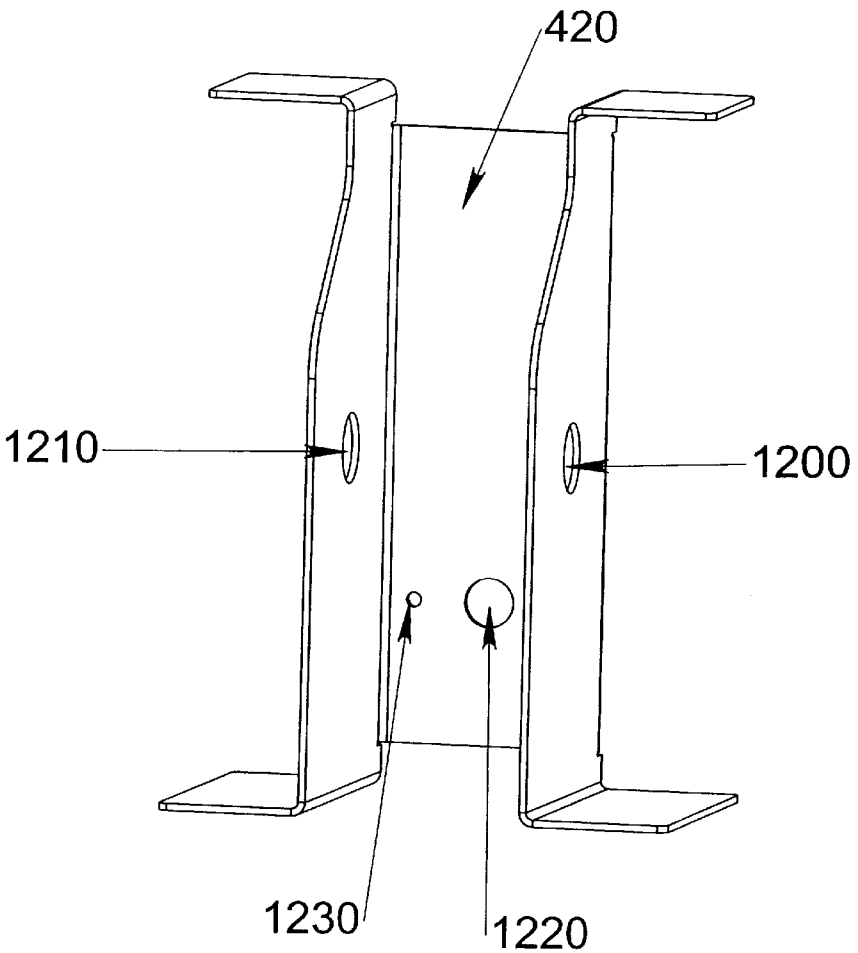
FIG. 12 illustrates a perspective view of the motor bracket of the table tennis ball distribution and storage apparatus shown in FIG. 4.

FIG. 12 illustrates a perspective view of the motor bracket 420 of the table tennis ball distribution and storage apparatus 150 shown in FIG. 4. The motor bracket 420 is designed to fit within the left outer body 200 and the right outer body 210. The motor bracket 420 is typically constructed of metal or other hardened material (such as hard plastic). A right reduction shaft hole 1200 and a left reduction shaft hole 1210 are formed in the motor bracket 420 to enable the reduction shaft 455 to be disposed on the bracket 420. The motor shaft is positioned thorough a motor shaft hole 1220 and the motor 410 is secured to the motor bracket 420 by means of two motor mounting holes 1230 (only one hole 1230 is shown in FIG. 12). In a preferred embodiment, the motor 410 is fastened to the motor bracket 420 using screws through the motor mounting holes 1230.

Figure 13:
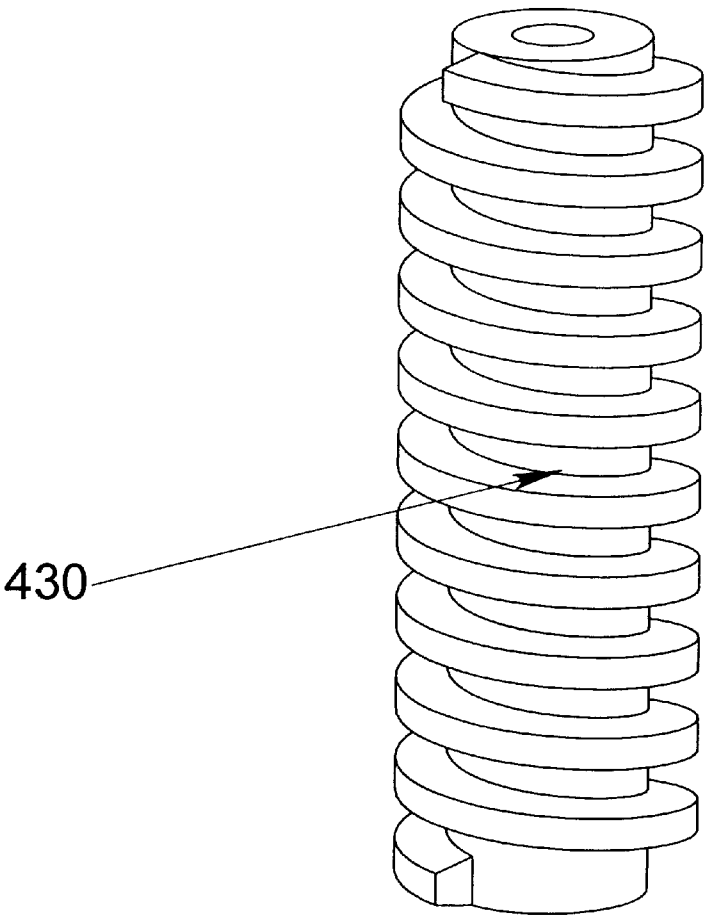
FIG. 13 illustrates the worm gear of the table tennis ball distribution and storage apparatus shown in FIG. 4.

FIG. 13 illustrates the worm gear 430 of the table tennis ball distribution and storage apparatus 150 shown in FIG. 4. The worm gear 430 is disposed on the shaft of the motor 410 and fits through the motor shaft hole 1220 of the motor bracket 420. The worm gear 430 has threads such that when the worm gear 430 rotates it is capable of displacement.

Figure 14:
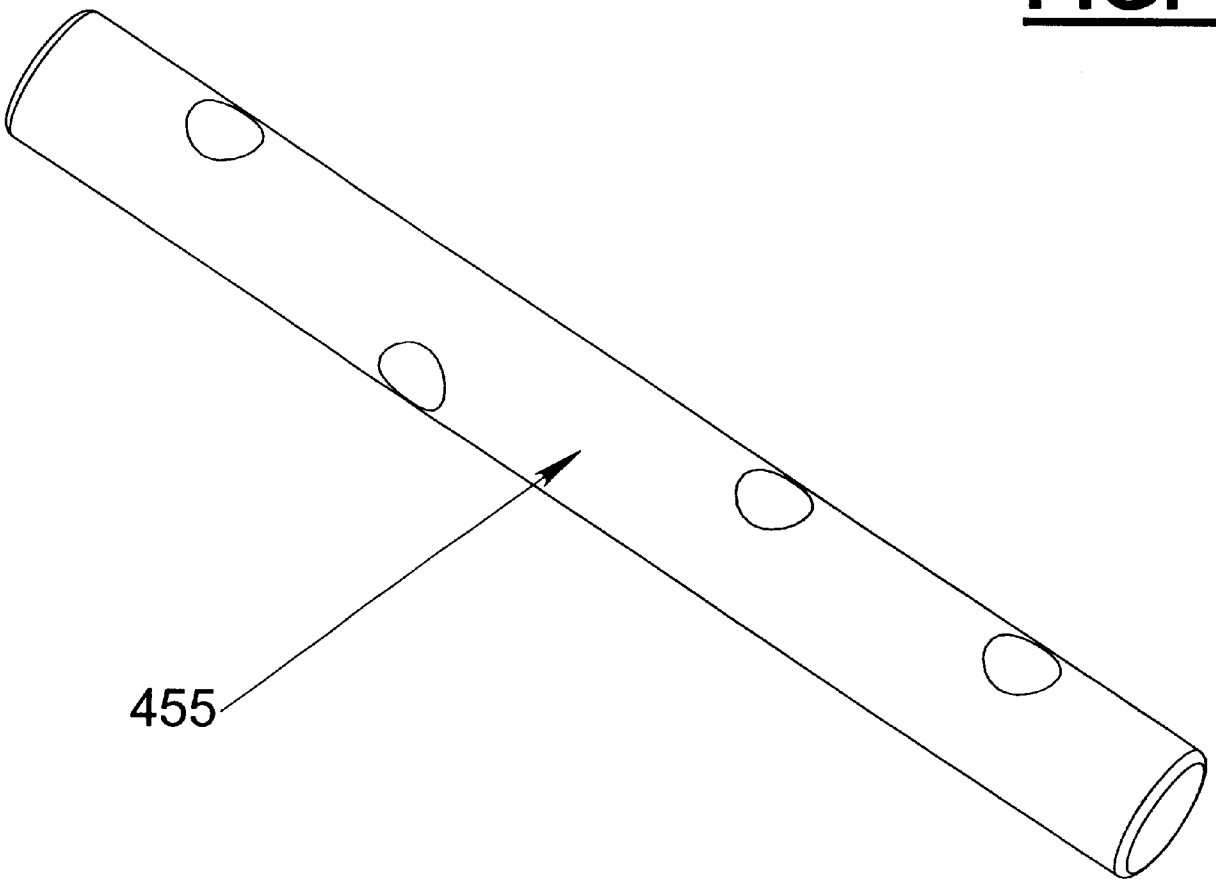
FIG. 14 illustrates a perspective view of the reduction shaft of the table tennis ball distribution and storage apparatus shown in FIG. 4.

FIG. 14 illustrates a perspective view of the reduction shaft 455 of the table tennis ball distribution and storage apparatus 150 shown in FIG. 4. The reduction shaft 455 is a rotatable spindle that contains thereon the reduction gear 440, left and right bushings 500, 505 and left and right cam wheels 450, 510. The reduction shaft 455 is disposed in the right reduction shaft hole 1200 and the left reduction shaft hole 1210 of the motor bracket 420 such that the shaft 455 can rotate freely.

Figure 15:
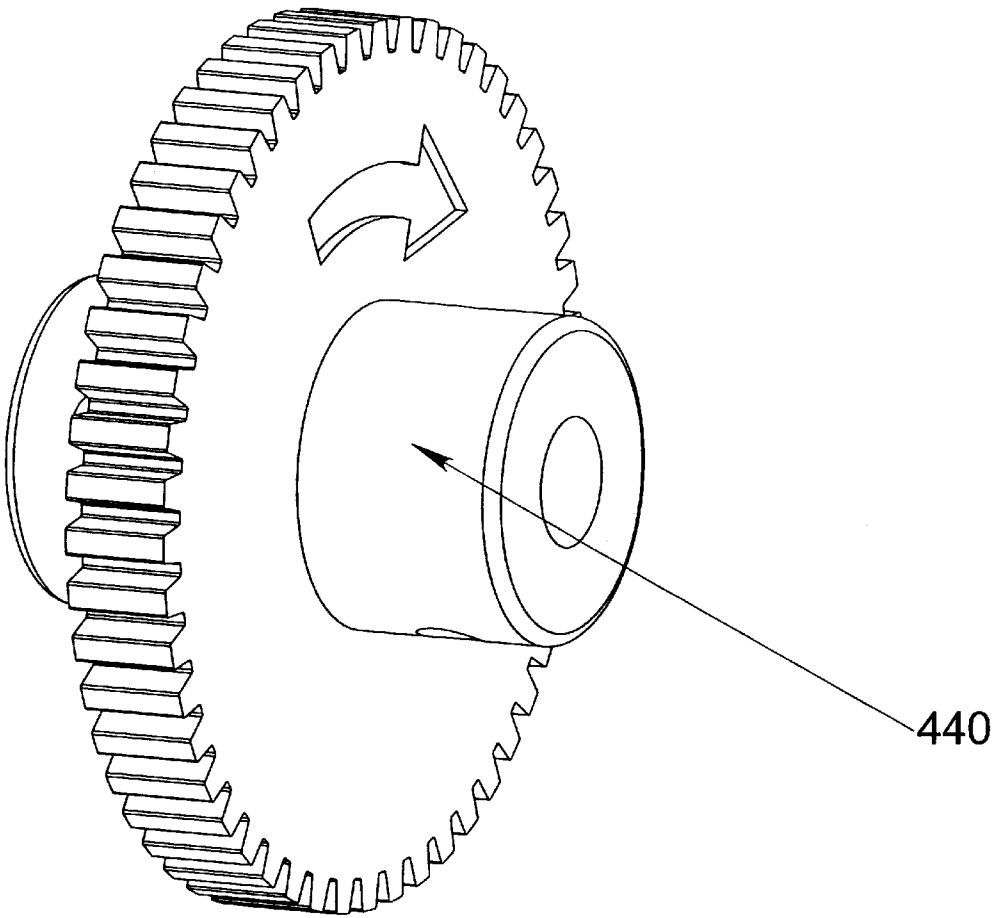
FIG. 15 illustrates a perspective view of the reduction gear of the table tennis ball distribution and storage apparatus shown in FIG. 4.
Figure 16:
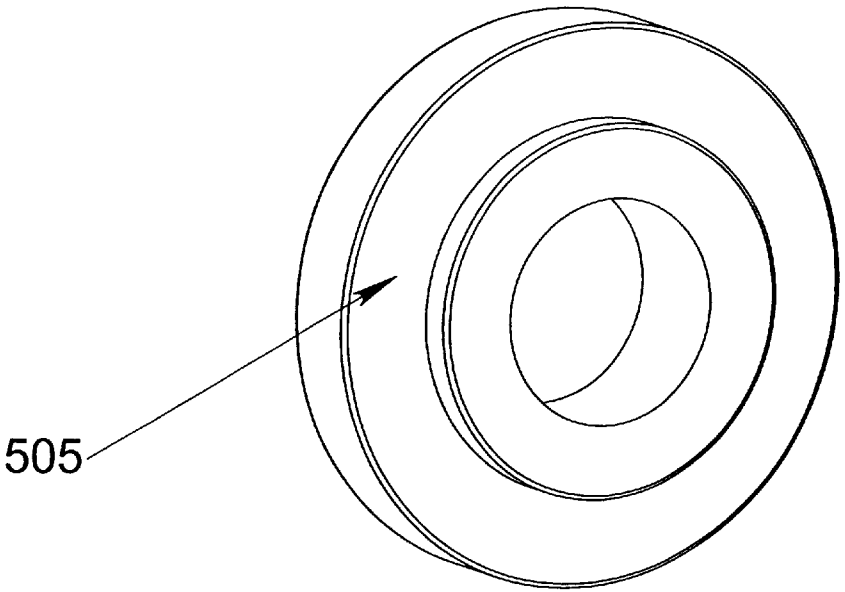
FIG. 16 illustrates a perspective view of the right bushing of the table tennis ball distribution and storage apparatus shown in FIG. 5.

FIG. 15 illustrates a perspective view of the reduction gear 430 of the table tennis ball distribution and storage apparatus 150 shown in FIG. 4. The reduction gear 430 has teeth that are engaged with the threads of the worm gear 430. This offset reduction gearing allows the motor 410 to turn the reduction gear 440 through the worm gear 430. FIG. 16 illustrates a perspective view of the right bushing 505 of the apparatus 150 shown in FIG. 5.

Integrated Ball Support/Feeder System

Figure 17:
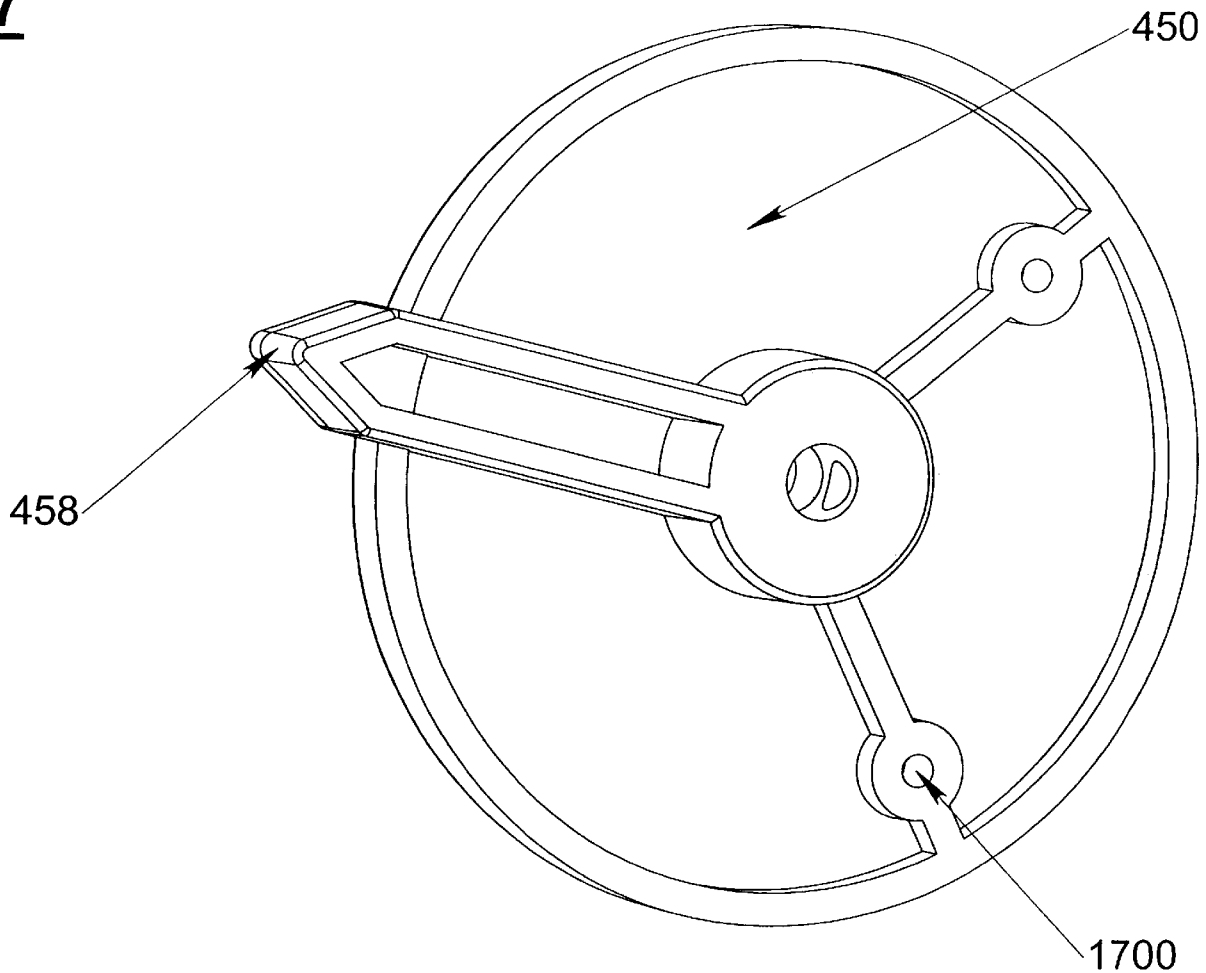
FIG. 17 illustrates the left cam wheel of the table tennis ball distribution and storage apparatus shown in FIG. 4.

The integrated ball support/feeder system both supports the balls in the tiered ball storage unit 180 and transports a single ball received from the from the storage unit 180 to the firing cavity 240. The integrated ball support/feeder system includes the cam wheels 450, 510, the arms 460, 520, and the slider 470. FIG. 17 illustrates the left cam wheel 450 of the table tennis ball distribution and storage apparatus 150 shown in FIG. 4. The cam wheel 450 is mounted on the reduction shaft 455 and is rotated as the reduction shaft 455 rotates. The cam wheel 455 includes a cam 458. As explained below, the cam 458 is used to depress the flipper system and arm the flipper spring 475. The left cam wheel 450 also includes a first left arm attachment point 1700.

Figure 18:
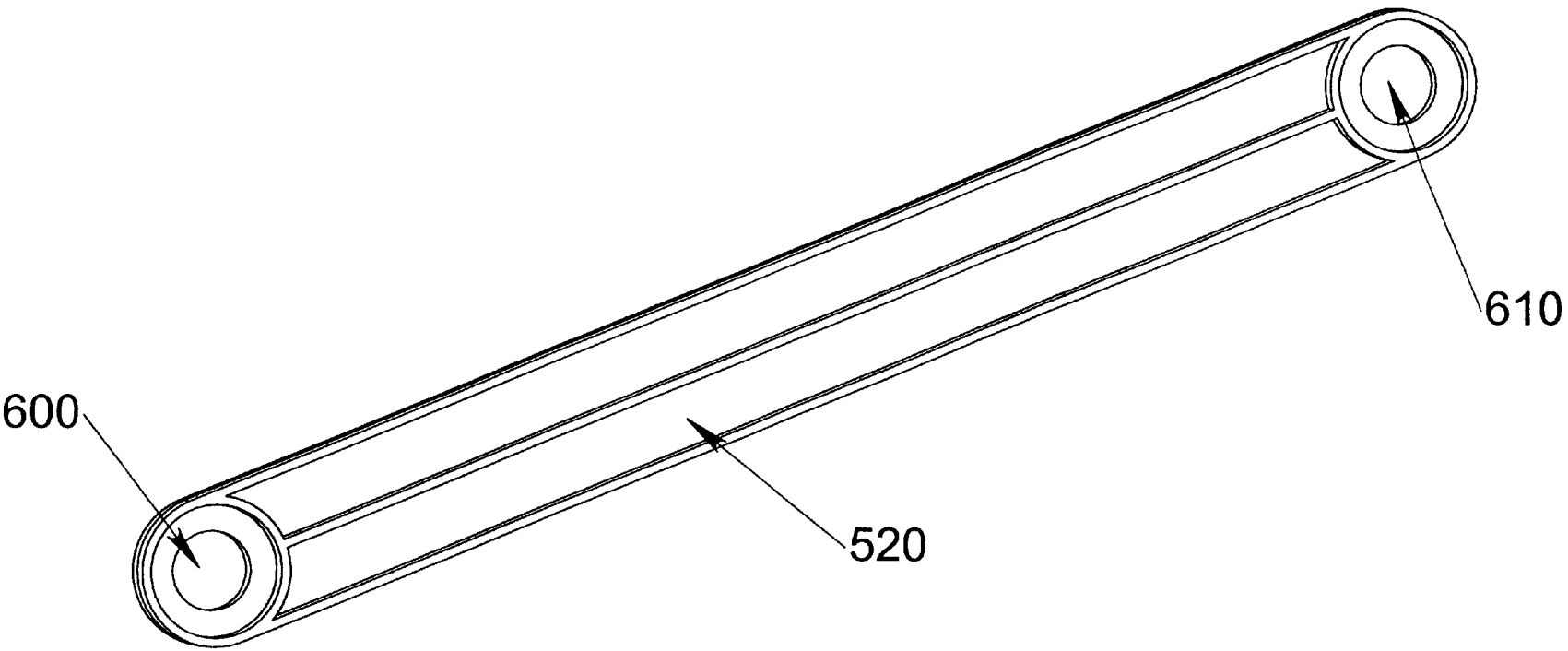
FIG. 18 illustrates the right arm of the table tennis ball distribution and storage apparatus shown in FIG. 5.

FIG. 18 illustrates the right arm 520 of the table tennis ball distribution and storage apparatus 150 shown in FIG. 5. The right arm 520 is rotatably attached at the first right arm attachment point 600 to the right cam wheel 510. Similarly, the right arm 520 is rotatably attached at the second right arm attachment point 610 to the slider 470. The arms 460, 520 provide a means to convert the rotational motion of the left and right cam wheels 450, 510 into the linear motion of the slider 470.

Figure 19:
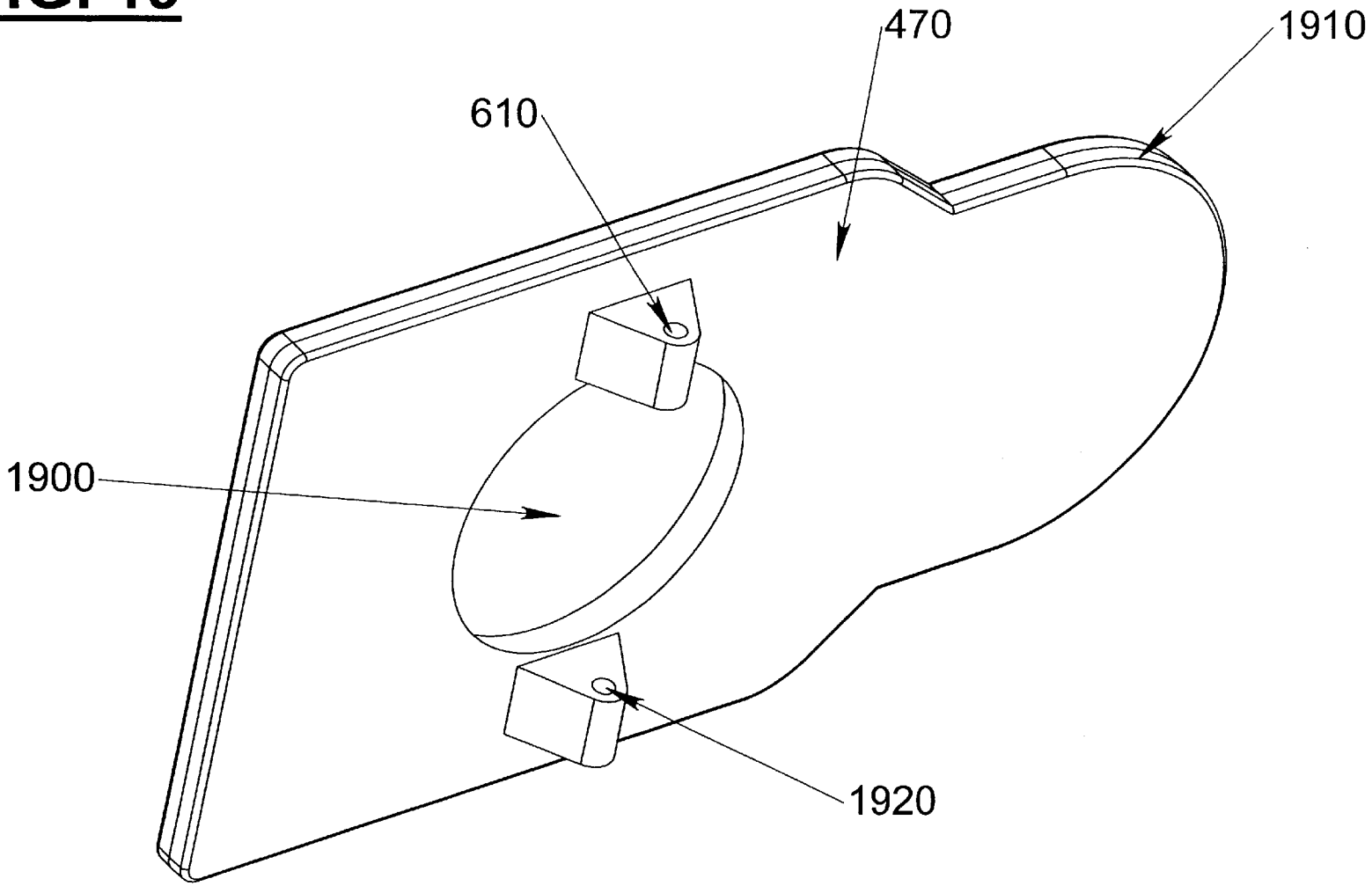
FIG. 19 illustrates a perspective view of the slider of the table tennis ball distribution and storage apparatus shown in FIG. 6.

FIG. 19 illustrates a perspective view of the slider 470 of the table tennis ball distribution and storage apparatus 150 shown in FIG. 6. The slider contains a ball holder 1900 that has a diameter such that a ball can be placed into the holder but not drop through the slider 470. In addition, the slider 470 includes a stopper plate 1910 that allows the slider 470 hold balls up in the tiered ball storage unit 180. The slider 470 is attached to the right arm 520 at the second right arm attachment point 610 while the left arm 460 is attached to the slider 470 at a second left arm attachment point 1920.

Flipper System

Figure 20:
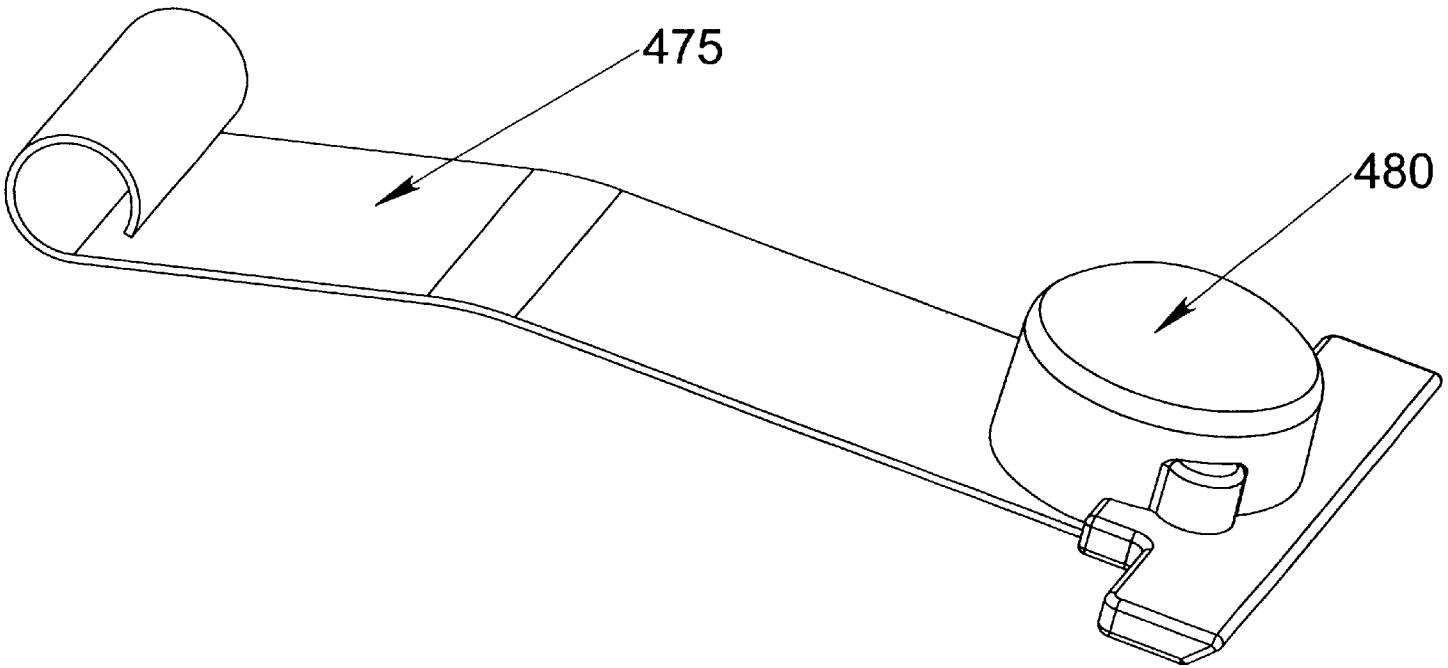
FIG. 20 illustrates a perspective view of the flipper system of the table tennis ball distribution and storage apparatus shown in FIG. 4.

The flipper system is used strike and propel the ball from the apparatus 150. When armed and released, this allows the flipper system to strike a ball sufficient in the firing cavity 240 with enough force to propel the ball from the firing cavity 240. FIG. 20 illustrates a perspective view of the flipper system of the table tennis ball distribution and storage apparatus 150 shown in FIG. 4. The flipper system includes the flipper spring 475 and the flipper foot 480.

Figure 21:
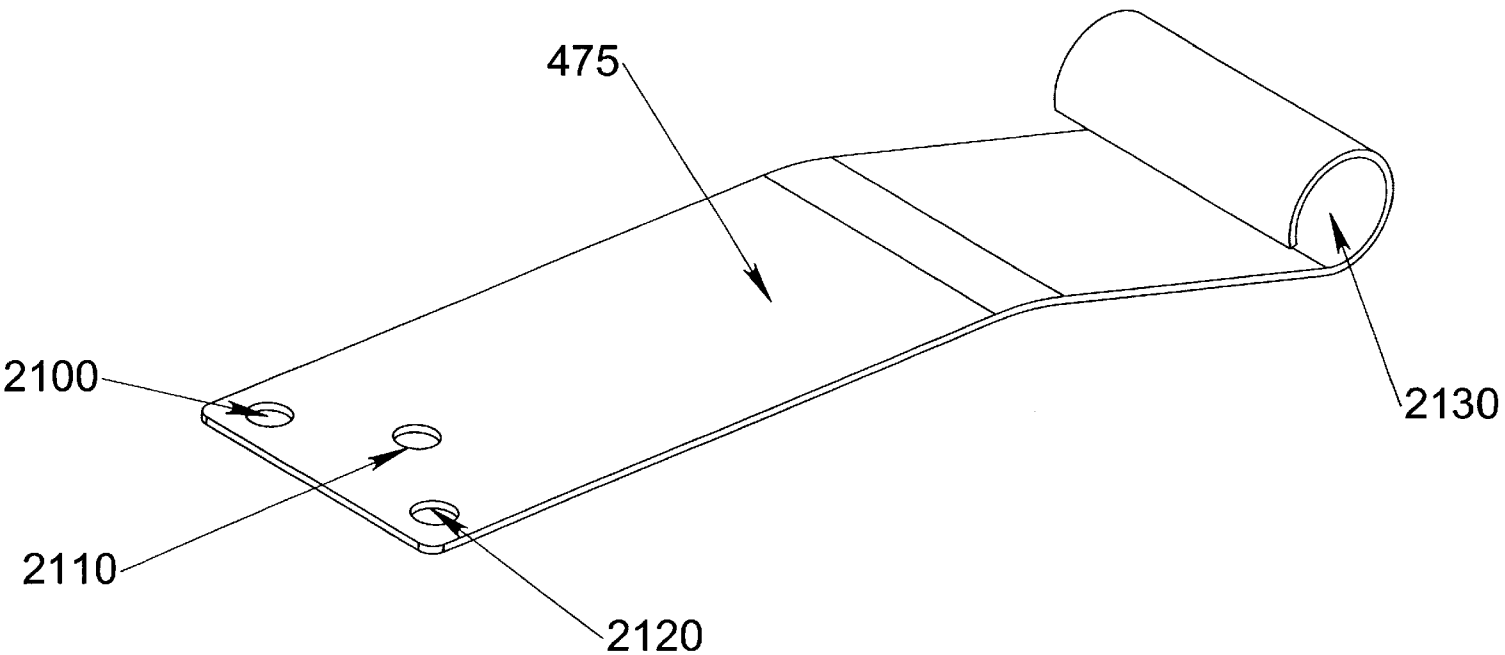
FIG. 21 illustrates a perspective view of the flipper spring of the flipper system shown in FIG. 20.

FIG. 21 illustrates a perspective view of the flipper spring 475 of the flipper system shown in FIG. 20. In a preferred embodiment, the flipper spring 475 is made of spring steel to provide a desirable return and longevity. In addition, constructing the flipper spring 475 of spring steel provides a desirable trajectory to the ball. In other words, the ball is projected with a force that causes the ball to land on the table 110. As shown in FIG. 21, the flipper spring 475 includes mounting holes 2100, 2110, 2120. Mounting holes 2100 and 2120 are for engaging mounting pins located on the flipper foot 480, while the center mounting hole 2110 is used to fasten the flipper foot 480 to the flipper spring 475. Typically, this is achieved using a screw means. The flipper spring 475 also includes a coiled end 2130 for attaching the spring 475 to the left and right outer bodies 200, 210. In particular, the coiled end 2130 is designed to slip over the rightmost flipper spring mounting pin 740 of the left outer body 200 shown in FIG. 7 and the corresponding mounting pin of the right outer body 210.

Figure 22:
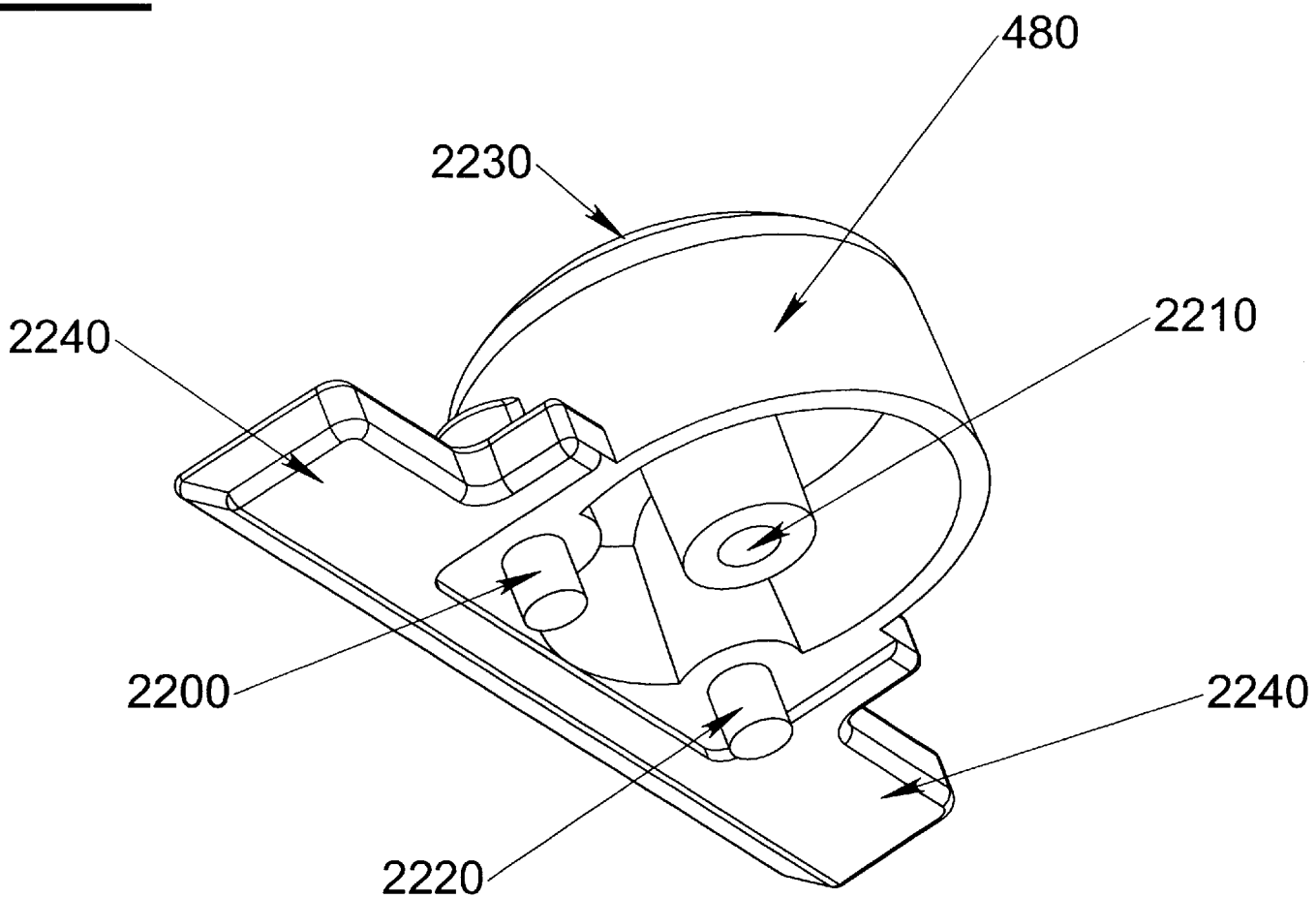
FIG. 22 illustrates a perspective view of the flipper foot of the flipper system shown in FIG. 20.

In order to increase ball distance and improve accuracy and trajectory, the flipper system includes a flipper foot 480 attached to the flipper spring 475. This provide improved performance over using the flipper spring 475 alone. FIG. 22 illustrates a perspective view of the flipper foot 480 of the flipper system shown in FIG. 20. In a preferred embodiment, the flipper foot 480 is constructed of a hard plastic material. Using a hard plastic material provides an increased trajectory over other materials.

The flipper foot 480 is attached to the flipper spring using mounting pins 2200, 2220 and a mounting hole 2210. The mounting pins 2200, 2220 are engaged into mounting holes 2100, 2120 of the flipper spring 475, while the center mounting hole 2210 is attached to the flipper spring 475 using a fastening means (such as a screw). The flipper foot 480 contains a striking area 2230 that contacts the ball 170. In addition, the flipper foot 480 contains cam tabs 2240 on either side and in front of the striking area 2230. These cam tabs 2240 are used to provide a surface for the cam 458 on the left cam wheel 460 and the cam on the right cam wheel 510 to depress and arm the flipper spring 475.

Actuator System

Figure 23:
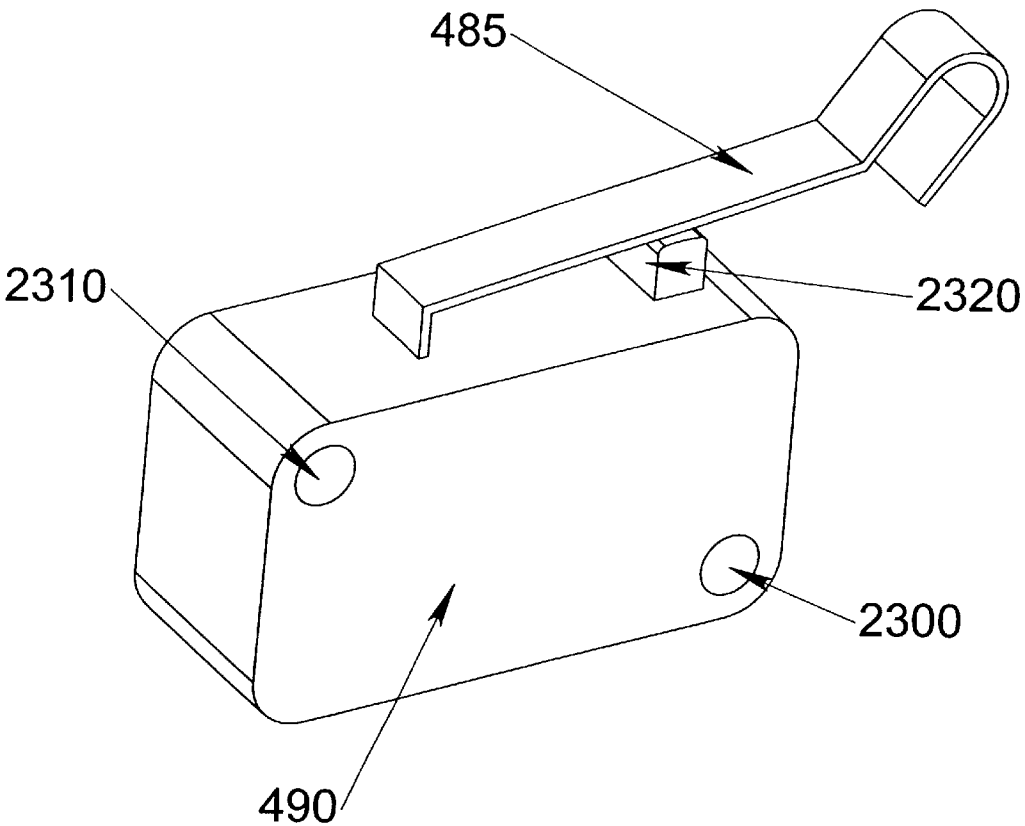
FIG. 23 illustrates a perspective view of the actuator unit of the table tennis ball distribution and storage apparatus shown in FIG. 4.

The apparatus 150 includes an actuator system that controls the timing of the flipper system. The actuator system includes the actuator arm 485 and the actuator unit 490 including the actuator switch 495. FIG. 23 illustrates a perspective view of the actuator unit 490 of the table tennis ball distribution and storage apparatus 150 shown in FIG. 4. The actuator unit 490 includes mounting holes 2300, 2310 for mounting the actuator unit 490 to the right outer body 210. The actuator unit 490 also include the actuator switch 495 that is controlled by the actuator arm 485.

IV. Operational Overview

The table tennis ball distribution and storage method described herein stores a plurality of table tennis balls and automatically distributes a single ball to a player. The ball is distributed at a correct angle, velocity and trajectory such that the player may immediately put the ball into play. The operation of the table tennis ball distribution and storage apparatus will now be discussed.

Referring to FIG. 4, a plurality of balls is loaded into the tiered ball storage unit 180. The ball at the bottom of the stack of balls in the storage unit 180 is held up by the slider 470. Specifically, referring to FIG. 19, the stopper plate 1910 on the slider 470 keeps the balls in check. Referring back to FIG. 4, when the cam 458 is at an approximately "2 o'clock" (if one was to imagine an immovable clock face on the cam wheel 450 with the "12 o'clock" position being straight up) position (i.e., pointing in the direction of the tiered ball storage unit 180), the motor 410 is stopped by the action of the cam depressing the flipper foot 480 and flipper spring 475, which in turn depresses the actuator arm 485, which in turn closes the actuator switch 495 to turn off power to the motor 410. The flipper spring 475 is depressed by the cams 458 on the left cam wheel 450 and the right cam wheel 510. When power to the motor 410 is cut the rotation of the cam wheels 450, 510 stops. At this point, the cam 458 is in contact with and depressing the flipper foot 480 such that the flipper system (the flipper foot 480 and flipper spring 475) is armed. Moreover, the ball 170 is loaded into the firing cavity 240 and the stopper plate 1910 is holding up any balls in the storage unit 180.

The above situation remains until the actuator button 190 is depressed. This is typically performed by a player when the player requires another ball. When the actuator button 190 is depressed, the actuator switch is overridden that is cutting power to the motor 410 is overridden and the motor 410 begins to rotate. This rotation also rotates the cam wheels 450, 510 in a clockwise direction (as shown by the arrow on the reduction gear 440). The cam wheels are rotated via the worm gear 430 and reduction gear 440. The cams on the cam wheels 450, 510 further depresses the flipper spring 475 until the flipper spring 475 releases and snaps upward to strike the ball 170. FIG. 4 illustrates the cam 458 at an approximately "3 o'clock" position. At this point, the cam wheels 450, 510 are rotating in a clockwise direction and the cam 458 has just lost contact with the flipper foot 480 and thus released the armed flipper spring 475. The flipper foot 480 and flipper spring 475 are moving upward to strike the ball 170.

The rotation of the cam wheels 450, 510 also causes the slider 470 to move forward and align with the feeder cavity 320. When the ball holder 1900 of the slider 470 and the feeder cavity 320 are aligned, a single ball is dropped into the ball holder 1900 and transported to the firing cavity 240. The cams are on the cam wheels 450, 510 are designed such that when the ball 170 is aligned in the firing cavity 240 the actuator switch 485 is depressed and the motor 410 stops. When desired, the player depresses the actuator button 190 again, the ball 170 is struck by the flipper system, and the entire cycle is repeated.

The foregoing description of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description of the invention, but rather by the claims appended hereto.

What is claimed is:

1. A table tennis ball distribution and storage apparatus, comprising:

an integral outer body having a firing cavity and a feeder cavity formed therein;

a tiered ball storage unit disposed on an upper side of the integral outer body that stores a plurality of table tennis balls and is in communication with the feeder cavity; and an integrated timing system disposed within the integral outer body that: (1) displaces a single ball from the feeder cavity to the firing cavity; (2) turns off a motor to keep the single ball within the firing cavity; and (3) arms a flipper system such that the flipper system is capable of propelling the single ball from the firing cavity upon command.

2. The table tennis ball distribution and storage apparatus as set forth in claim 1, wherein the tiered ball storage unit is a half-cylindrical spiral structure having modular tiered units to allow stacking of additional tiers to increase capacity.

3. The table tennis ball distribution and storage apparatus as set forth in claim 1, wherein the integrated timing system further comprises:

an integrated ball support/feeder system that supports the plurality of balls in the tiered ball storage unit and transports the single ball from the feeder cavity to the firing cavity.

4. The table tennis ball distribution and storage apparatus as set forth in claim 3, wherein the integrated ball support/feeder system further comprises:

a cam wheel having a cam thereon and driven by the motor;

a slider having a ball holder having a diameter such that the single ball can fit into the ball holder without passing entirely through and having a stopper plate that holds the plurality of balls up in the tiered ball storage unit;

an arm connecting the cam wheel to the slider such that rotational motion of the cam wheel is convert into linear motion of the slider.

5. The table tennis ball distribution and storage apparatus as set forth in claim 4, wherein the cam is used to turn off the motor and to arm the flipper system.

6. The table tennis ball distribution and storage apparatus as set forth in claim 1, wherein the integrated timing system further comprises a flipper system that is used to strike the single ball within the firing cavity and wherein the flipper system further comprises:

a flipper spring mounted under the firing cavity and a constructed of a resilient material that snaps back to approximately its original position when displaced; and a flipper foot mounted on the flipper spring such that flipper foot strikes the ball and constructed of a hard material.

7. The table tennis ball distribution and storage apparatus as set forth in claim 6, wherein the flipper spring is mounted such that the flipper spring activates an actuator switch to turn off the motor when the flipper system is armed.

8. The table tennis ball distribution and storage apparatus as set forth in claim 1, wherein the integrated timing system further comprises an actuator system that controls the timing of the flipper system, the actuator system further comprising:

an actuator unit having an actuator switch thereon for turning on and off the motor; and an actuator arm mounted on the actuator unit and in communication with the switch such that when the actuator arm is depressed the actuator switch turns off the motor and when the actuator arm is in a normal position the actuator switch turns on the motor.

9. The table tennis ball distribution and storage apparatus as set forth in claim 8, wherein the actuator arm is in communication with the flipper system such that when the flipper system is armed the motor is turned off.

10. The table tennis ball distribution and storage apparatus as set forth in claim 1, further comprising an offset gear reduction system having a worm gear dynamically coupled to a reduction gear that drives the integrated timing system.

11. A table tennis ball distribution and storage apparatus that stores a plurality of table tennis balls and automatically propels a single ball from the plurality of table tennis balls from the apparatus, comprising:

an integral outer body having a left outer body and a right outer body and a firing cavity and a feeder cavity formed in an upper side of the integral outer body;

a tiered ball storage unit disposed on the upper side of the integral outer body for storing a plurality of table tennis balls and is in communication with the feeder cavity;

a motor mounted within the integral outer body;

a cam wheel having a cam thereon and coupled to the motor;

a slider coupled to the cam wheel that moves in a linear motion between the feeder cavity and the firing cavity so as to receive the single ball from the feeder cavity and displace the single ball to the firing cavity;

a flipper system mounted within the integral outer body such that the cam is capable of depressing and arming the flipper system; and an actuator system in communication with the flipper system and the motor such that the motor can be turned off by the flipper system.

12. The table tennis ball distribution and storage apparatus of claim 11, further comprising an actuator button in communication with the actuator system to turn on the motor and release the armed flipper system and strike the single ball in the firing cavity.

13. The table tennis ball distribution and storage apparatus of claim 11, wherein the tiered ball storage unit further comprises modular tiers, with each modular tier having a semi-cylindrical shelf in a circular, serpentine configuration for a storing the plurality of table tennis balls.

14. The table tennis ball distribution and storage apparatus of claim 11, wherein the actuator system further comprises:

an actuator arm mounted on the actuator unit and capable of being depressed by the flipper system; and an actuator switch that is depressed by the actuator arm when the actuator arm is depressed and in communication with the motor such that the motor is turned off when the actuator arm is depressed.

15. A table tennis ball distribution and storage apparatus for storing table tennis balls and automatically ejecting a single ball on command from the apparatus, comprising:

a first outer body having a firing cavity and a feeder cavity formed in an upper side of the left outer body;

a motor having a worm gear disposed on a shaft of the motor and mounted on a motor bracket within the first outer body;

a reduction gear dynamically coupled to the worm gear and mounted on the motor bracket;

a first cam wheel having a cam disposed on the outer perimeter of the first cam wheel and mounted on the motor bracket that is rotated by the reduction gear;

a flipper system having a resilient flipper spring located in the first outer body such that the flipper spring is depressed and armed by the cam as the first cam wheel rotates and released and the first cam wheel continues its rotation;

an actuator arm disposed under the flipper spring such that when the flipper spring is depressed by the cam the actuator arm is also depressed;

an actuator unit having the actuator arm mounted thereon and having an actuator switch in electric communication with the motor such that the actuator switch shuts off the motor when the actuator arm is depressed;

a slider having at one end a ball holder capable of containing a single table tennis ball and translating the single table tennis ball from the feeder cavity to the firing cavity; and a first arm connecting the first cam wheel to the slider such that the slider travels in a linear motion back and forth within the first outer body between the feeder cavity and the firing cavity as the first cam wheel rotates.

16. The table tennis ball distribution and storage apparatus as set forth in claim 15, further comprising a tiered ball storage unit that holds the table tennis balls and is disposed on an upper end of the first outer body.

17. The table tennis ball distribution and storage apparatus as set forth in claim 16, wherein the tiered ball storage unit is a modular unit having a plurality of tiers that are stacked on each other to increase ball storage capacity.

18. The table tennis ball distribution and storage apparatus as set forth in claim 16, wherein the slider further comprises a stopper plate that covers a lower end of the feeder cavity to allow a single ball of the table tennis balls to enter the feeder cavity and prevents other table tennis balls from leaving the tiered ball storage unit.

19. The table tennis ball distribution and storage apparatus as set forth in claim 15, wherein the ball holder of the slider has a void having a diameter such that the a single table tennis ball may sit within the ball holder without passing through.

20. The table tennis ball distribution and storage apparatus as set forth in claim 15, wherein the flipper system further comprises a flipper foot mounted on the flipper spring such that the flipper foot contact the single table tennis ball when the flipper spring is released.

21. A method for storing a plurality of table tennis balls and distributing a single ball from the plurality of table tennis balls to a player, comprising:

transporting the single ball from a tiered ball storage unit to a firing cavity to load the single ball into the firing cavity;

turning off a motor that is transporting the single ball when the single ball reaches the firing cavity;

arming a flipper system to ready the flipper system to strike the single ball in the firing cavity; and causing the motor to turn on such that the flipper system is released and strikes the single ball to propel the single ball from the firing cavity.

22. The method as set forth in claim 21, further comprising storing the plurality of table tennis balls in the tiered ball storage unit until each ball is ready to be loaded into the firing cavity.

23. The method as set forth in claim 21, wherein turning off a motor further comprises depressing the flipper system to cause an actuator switch in electrical communication with the motor to stop power to the motor.

24. The method as set forth in claim 23, further comprising using a cam wheel dynamically coupled to the motor and having a cam to depress the flipper system.

25. The method as set forth in claim 23, wherein causing the motor to turn on further comprises overriding the actuator switch.

26. The method as set forth in claim 25, further comprising loading another ball of the plurality of table tennis balls into the firing cavity by transporting the ball from the feeder cavity to the firing cavity and stopping the motor when the ball reaches the firing cavity.

* * * * *